United States Patent [19]

Zettler

[11] 4,048,886

[45] Sept. 20, 1977

[54] BRAKE MONITOR WITH SELF-CHECKING

[75] Inventor: John Francis Zettler, Stow, Mass.

[73] Assignee: Xenex Corporation, Birmingham, Mich.

[21] Appl. No.: 724,059

[22] Filed: Sept. 16, 1976

[51] Int. Cl.[2] ..... B21J 7/46

[52] U.S. Cl. ..... 83/58; 192/144; 72/26

[58] Field of Search ..... 192/129 A, 144; 83/DIG. 1, 58; 100/53; 72/26, 1

[56] References Cited

U.S. PATENT DOCUMENTS

| | | | |
|---|---|---|---|
| 3,636,545 | 1/1972 | Boyd et al. | 340/419 X |
| 3,931,727 | 1/1976 | Luenser | 100/53 |

*Primary Examiner*—Eugene G. Botz

*Attorney, Agent, or Firm*—Reising, Ethington, Barnard

[57] ABSTRACT

A monitoring system is disclosed for measuring and classifying the decelerating capabilities of a machine, such as a punch press. The monitoring system includes a timing circuit for measuring the elapsed time from the initiation of brake application to the stopping of the press. Means are provided to distinguish between a regular top-stop in a single stroke press cycle from an emergency stop and to shut down the press if the stopping time is excessive for the type of stop being executed. The monitoring means is provided with a self-checking system which performs dynamic self-checking at the initiation of braking, at the stopping of the press, and at the initiation of clutching. In each self-checking cycle a fault simulating signal is propagated through two independent paths or through a path which has been previously checked. The fault simulating signal will cause the press to be shut down unless it causes a control signal to change from an enabling state to a disabling state and back to the enabling state in less time than that required for the actuation of the relay means for shutting down the press.

22 Claims, 21 Drawing Figures

BRAKE MONITOR WITH SELF-CHECKING

FIELD OF THE INVENTION

This invention relates to safety control systems for machines; more particularly it relates to a system for monitoring the stopping capability of the machine brake.

BACKGROUND OF THE INVENTION

In certain industrial machines such as punch presses and the like, the safety of the operator depends to a considerable extent upon the stopping capability of the machine. For example, when a punch press is operated in a single stroke mode, it is expected by the operator that the press will come to a stop at the end of each stroke cycle by reason of the automatic top-stop control. Further, modern presses are now commonly fitted with safeguard systems which call for an emergency stop or safety stop of the press when the operator intrudes into the pinch-point region of the press. In case either a top-stop or a safety stop is called for but the brake is incapable of stopping the press in a given time or distance, the operator is likely to be seriously injured. Safety in operation of the press depends upon a machine brake which is capable of producing a stop with a given deceleration. Further, if the brake is incapable of stopping the machine safely, the machine should be shut down and remain inoperative until supervisory control is invoked.

BRIEF SUMMARY OF THE INVENTION

In accordance with this invention, a brake monitor is provided for punch presses and the like. The brake monitor measures the deceleration of the machine each time it is brought to a stop and registers the condition of the brake. In particular, if a machine is brought to a stop within an acceptable stopping time, and hence distance, after initiation of brake application, the monitor indicates a safe stop, as by displaying a green light. If the stopping time for the operating condition of the press is within the safe range but is approaching an unsafe value, the monitor indicates a warning condition as by displaying a yellow light. If the stopping time exceeds a predetermined safe value, the monitor indicates that operation of the machine is hazardous as by displaying a red light and also it shuts down the machine to prevent further operation without supervisory intervention.

Further, in accordance with this invention means are provided to ensure the dependability of the brake monitor itself. This is accomplished by a self-checking system incorporated into the circuits of the brake monitor so that a malfunction in the monitor will be indicated and will cause the machine to be shut down. In general, this is accomplished by setting up a fault condition in response to a selected monitor operating signal; the fault condition is propagated through the monitor and if the proper response is evoked at the output of the monitor the fault will be cleared to allow normal operation of the monitor. Preferably, the fault condition is set up in each operating cycle of the machine. To ensure the reliability of the self-checking function, the fault condition is preferably set up through more than one path or paths that have been checked or will be checked within the same cycle.

DETAILED DESCRIPTION OF THE INVENTION

A more complete understanding of this invention may be obtained from the detailed description that follows, taken with the accompanying drawings in which.

Figure 6A:
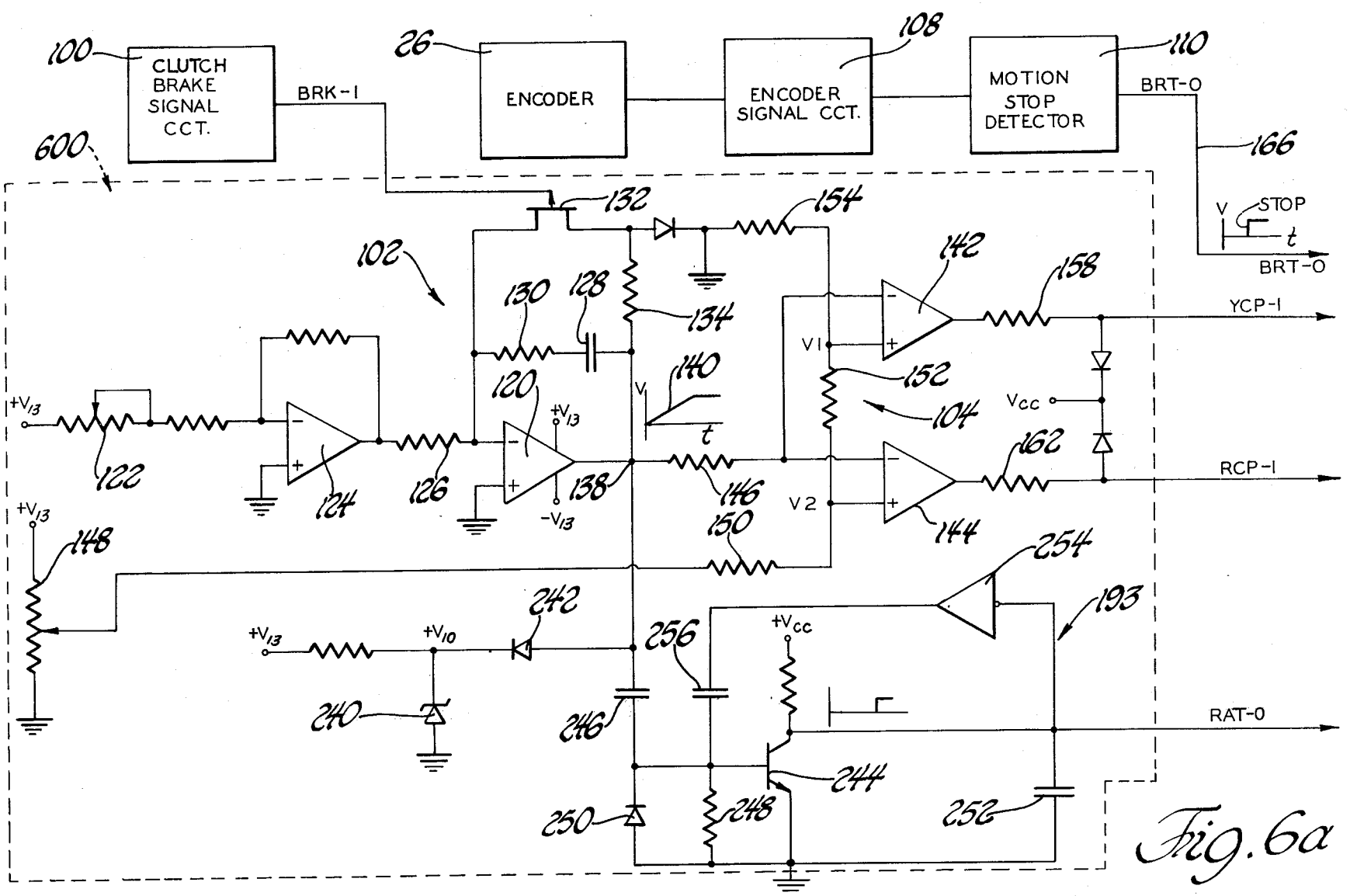
Figure 6B:
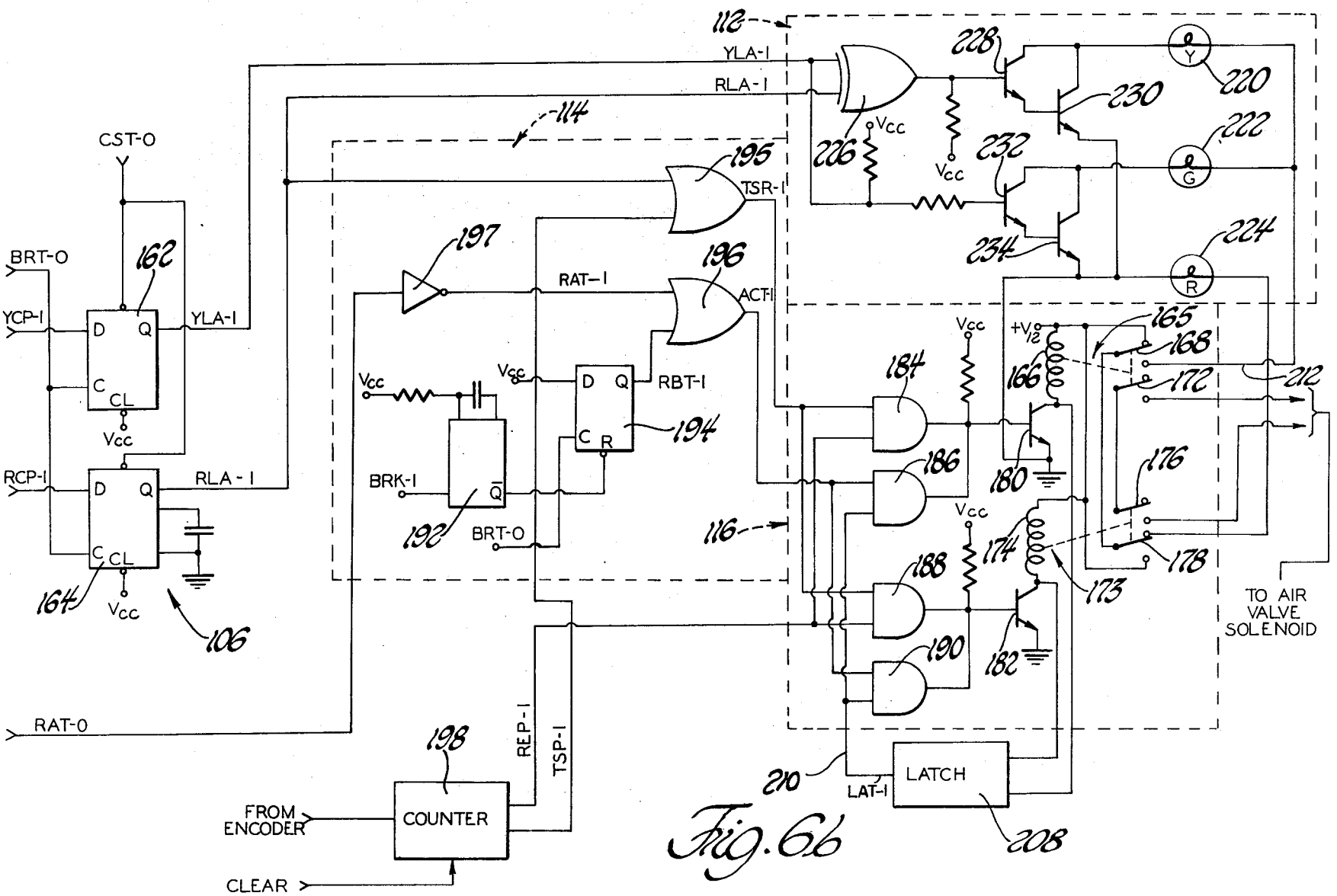
Figure 7:
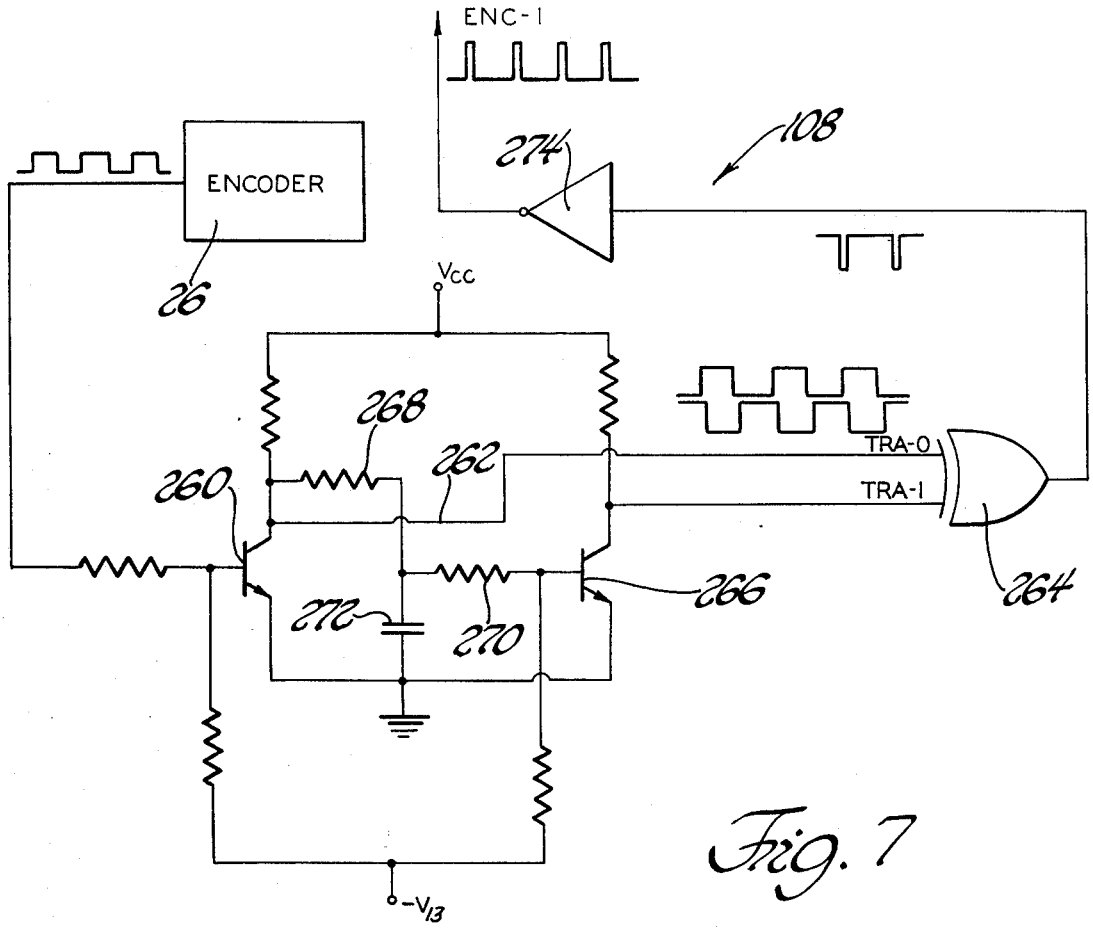
Figure 8:
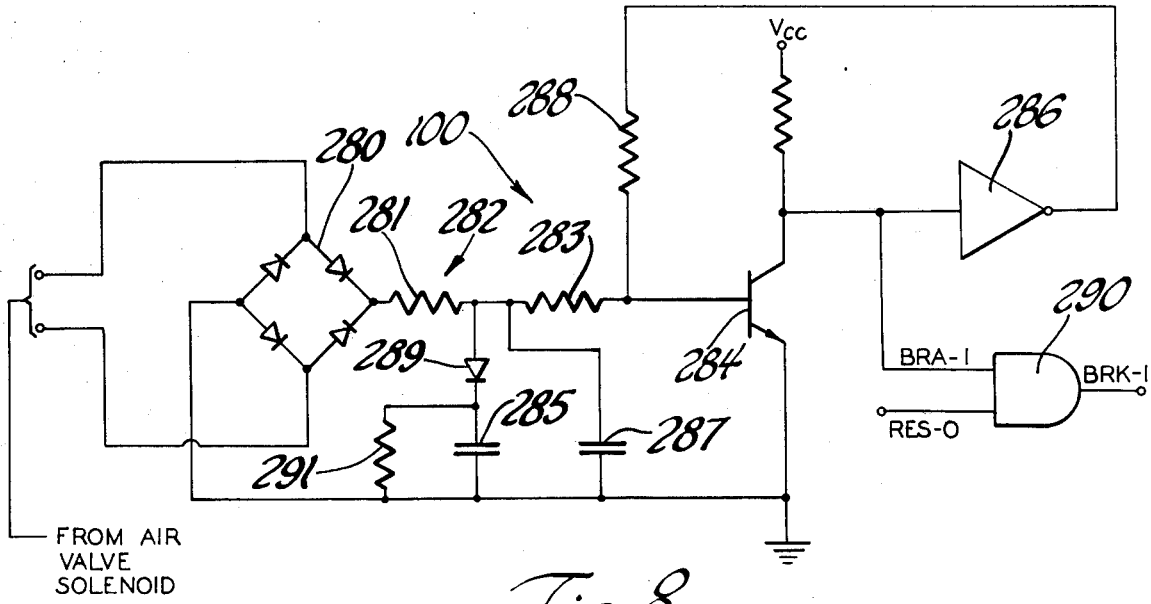
Figure 9:
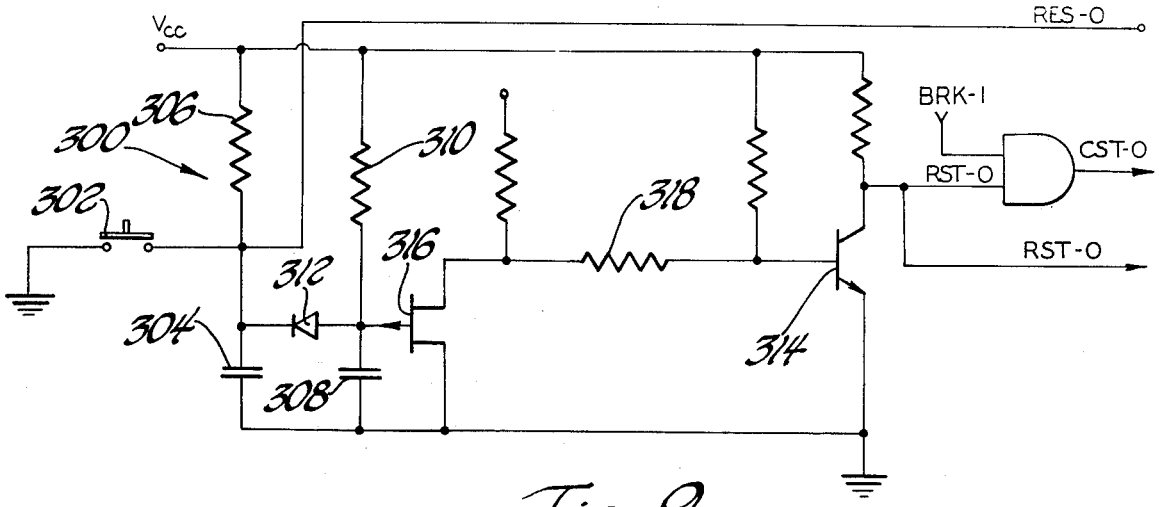
Figure 10:
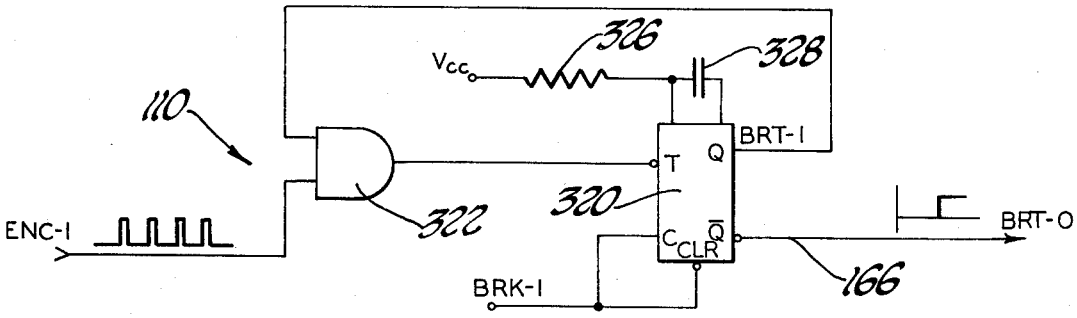
Figure 11:
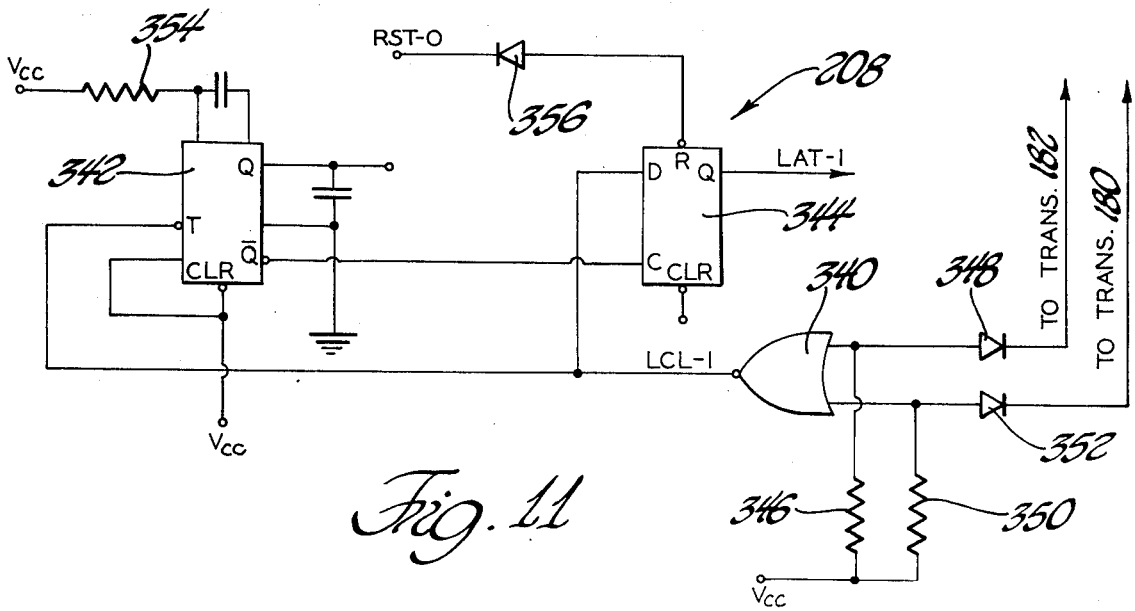
Figure 12:
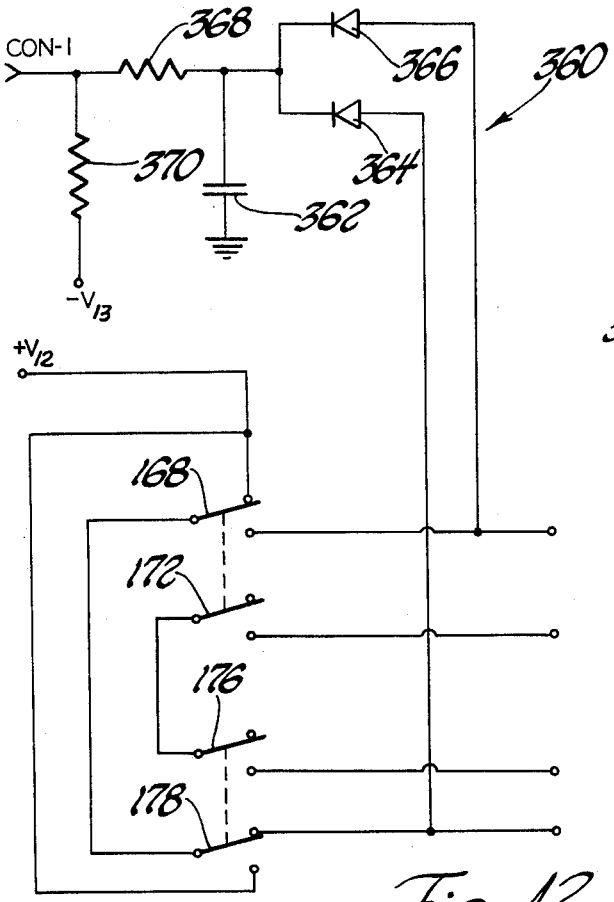
Figure 13:
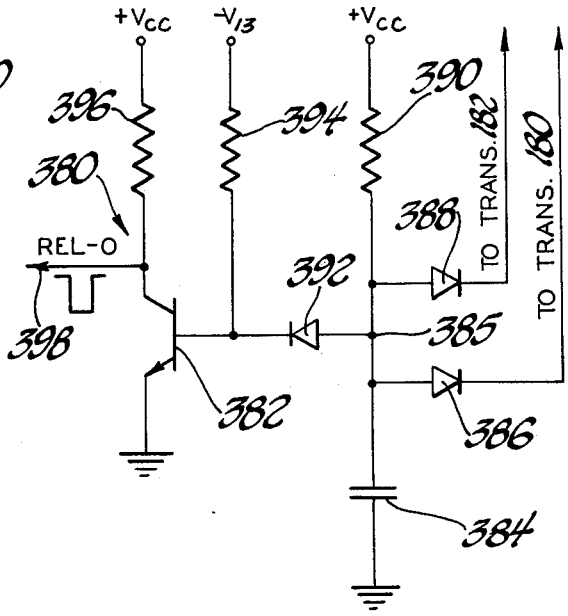
Figure 14:
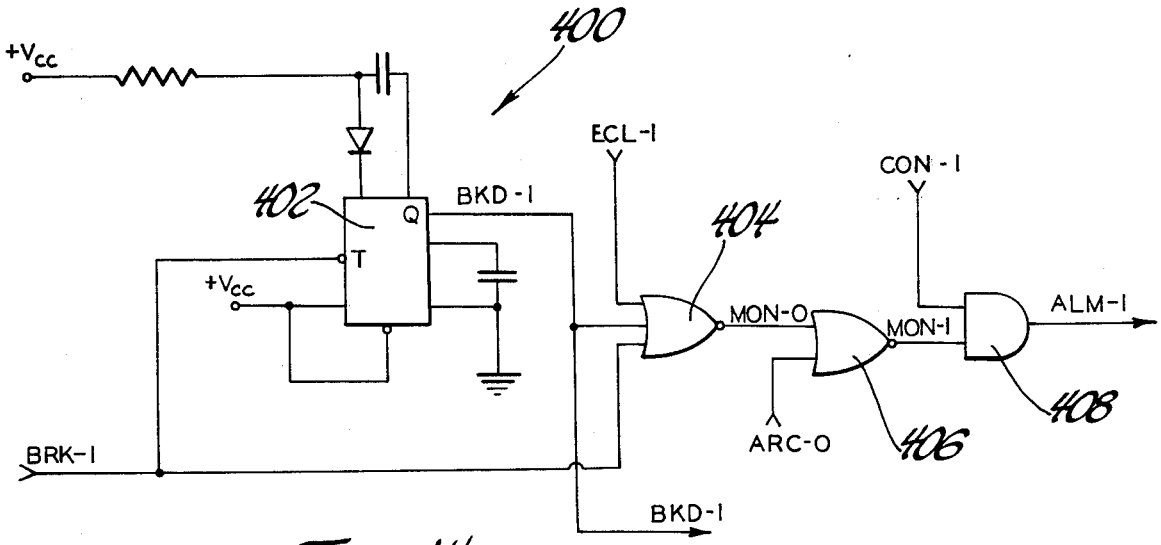
Figure 15:
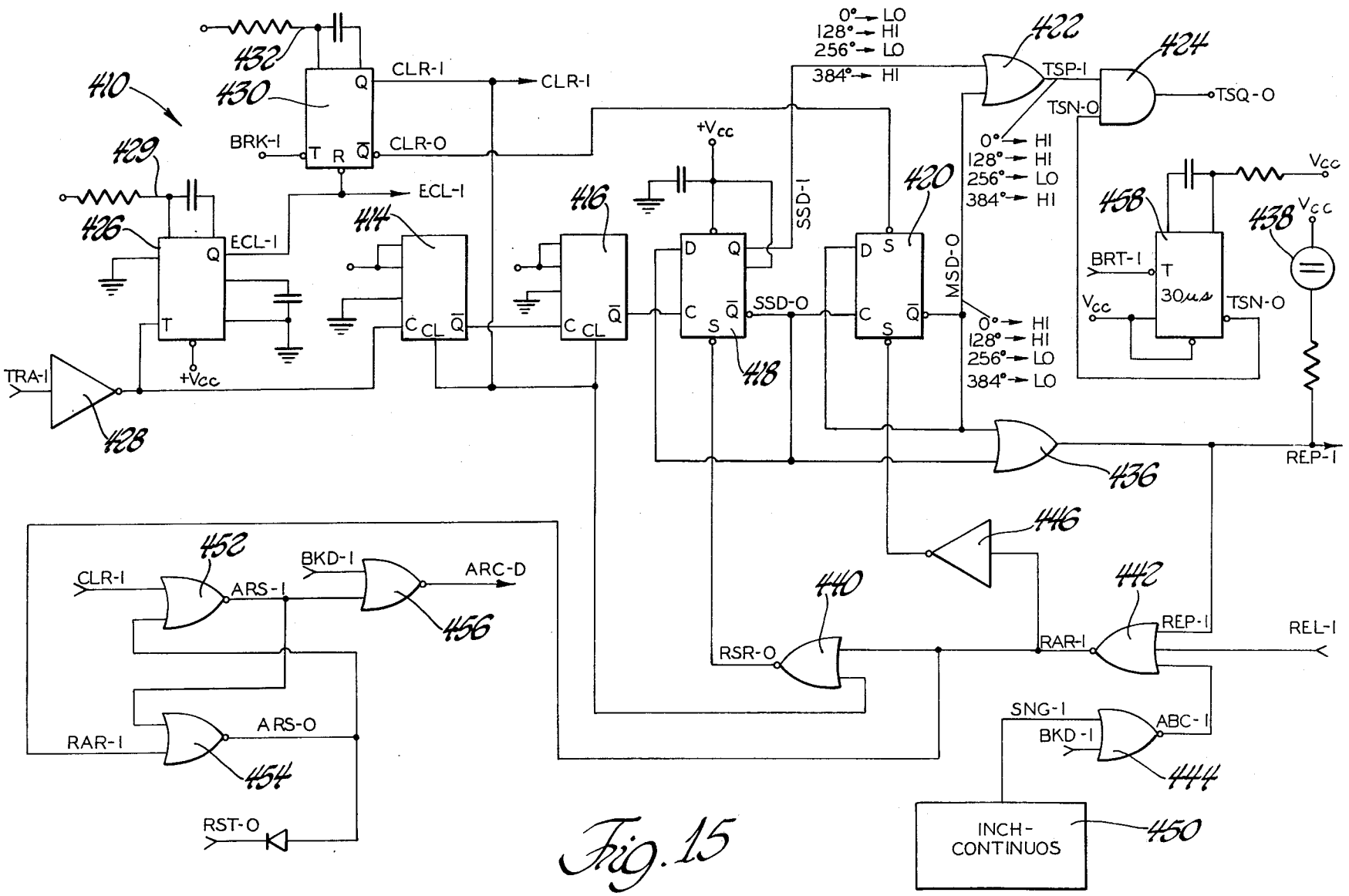
Figure 16A:
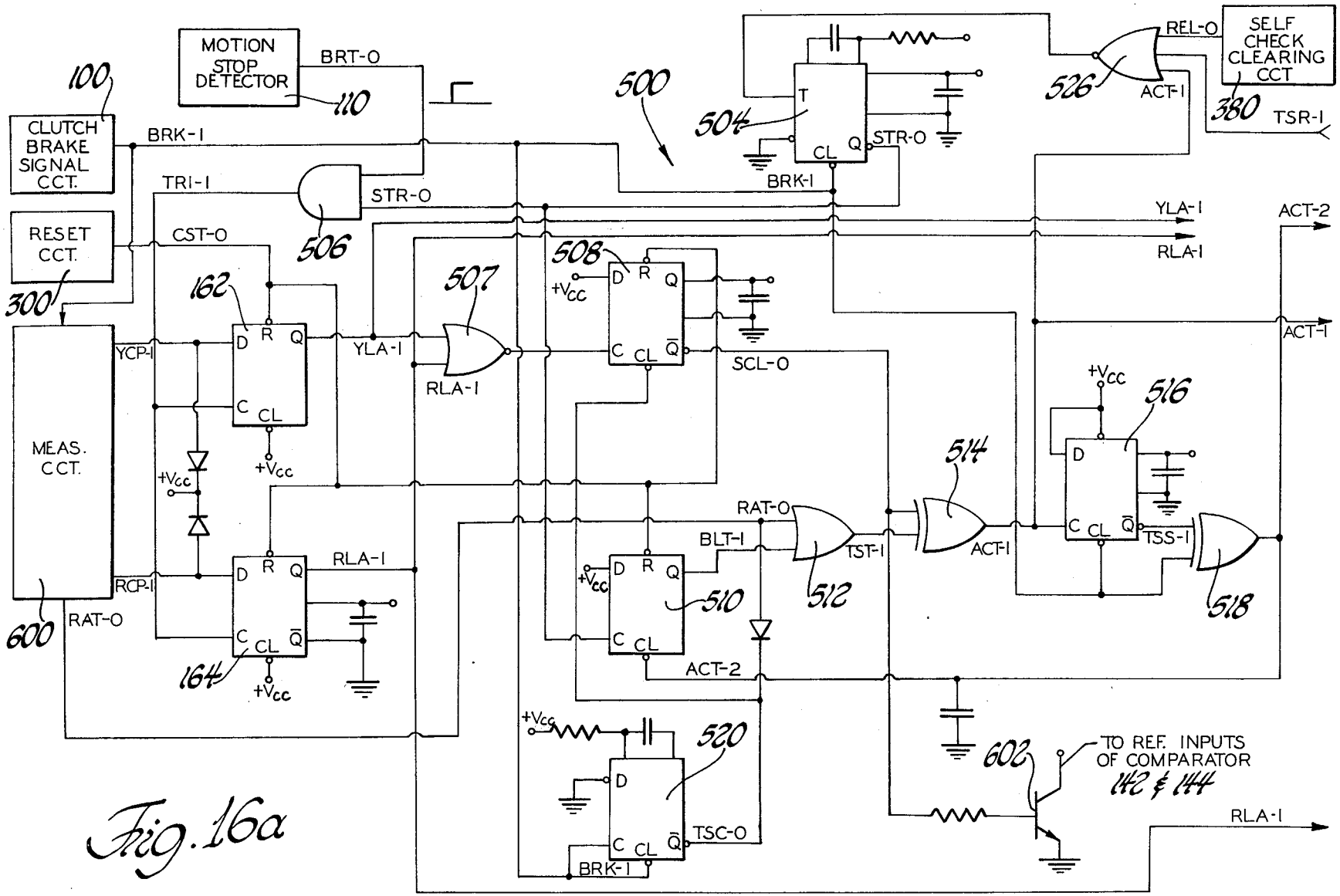
Figure 16B:
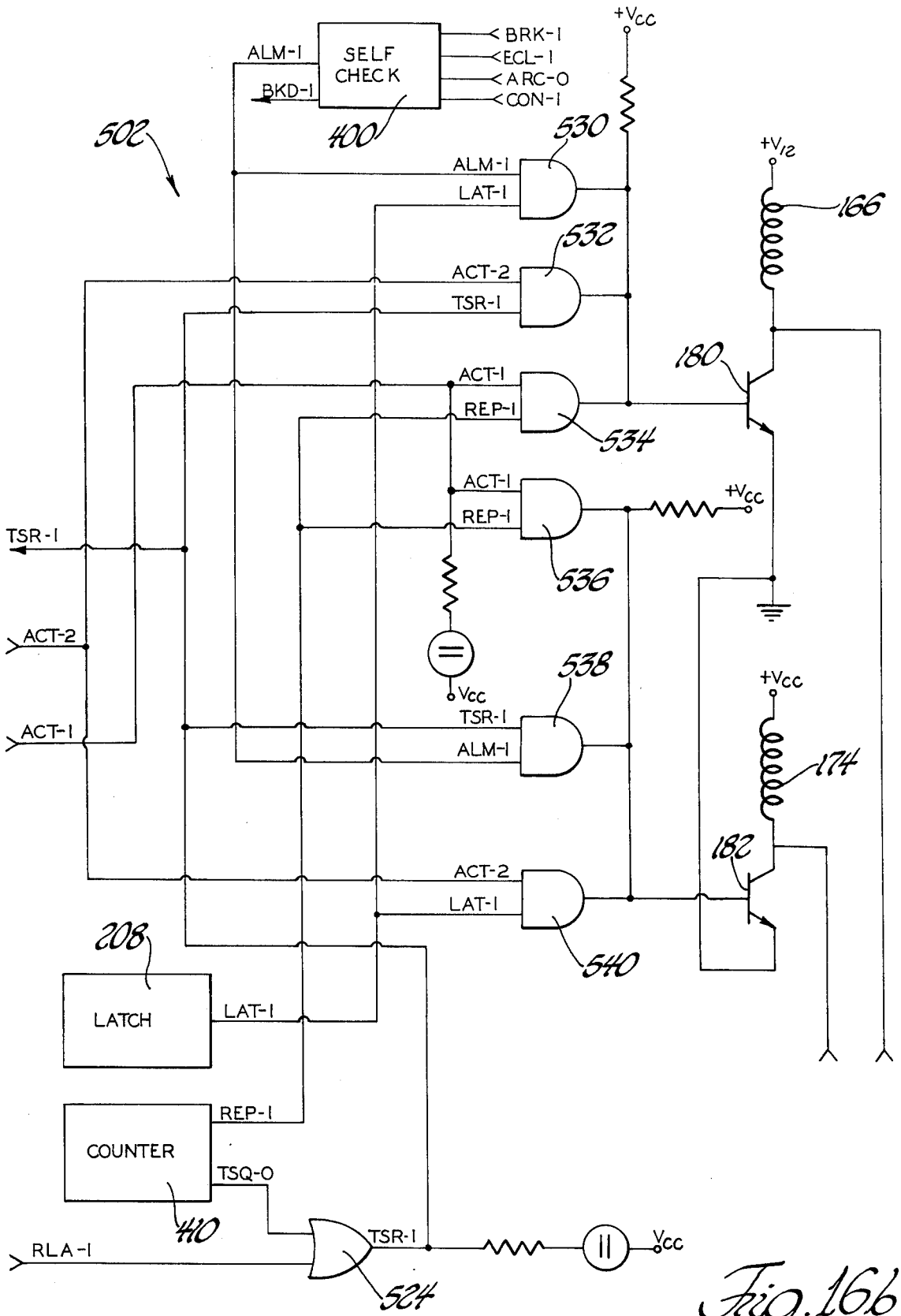
Figure 17:
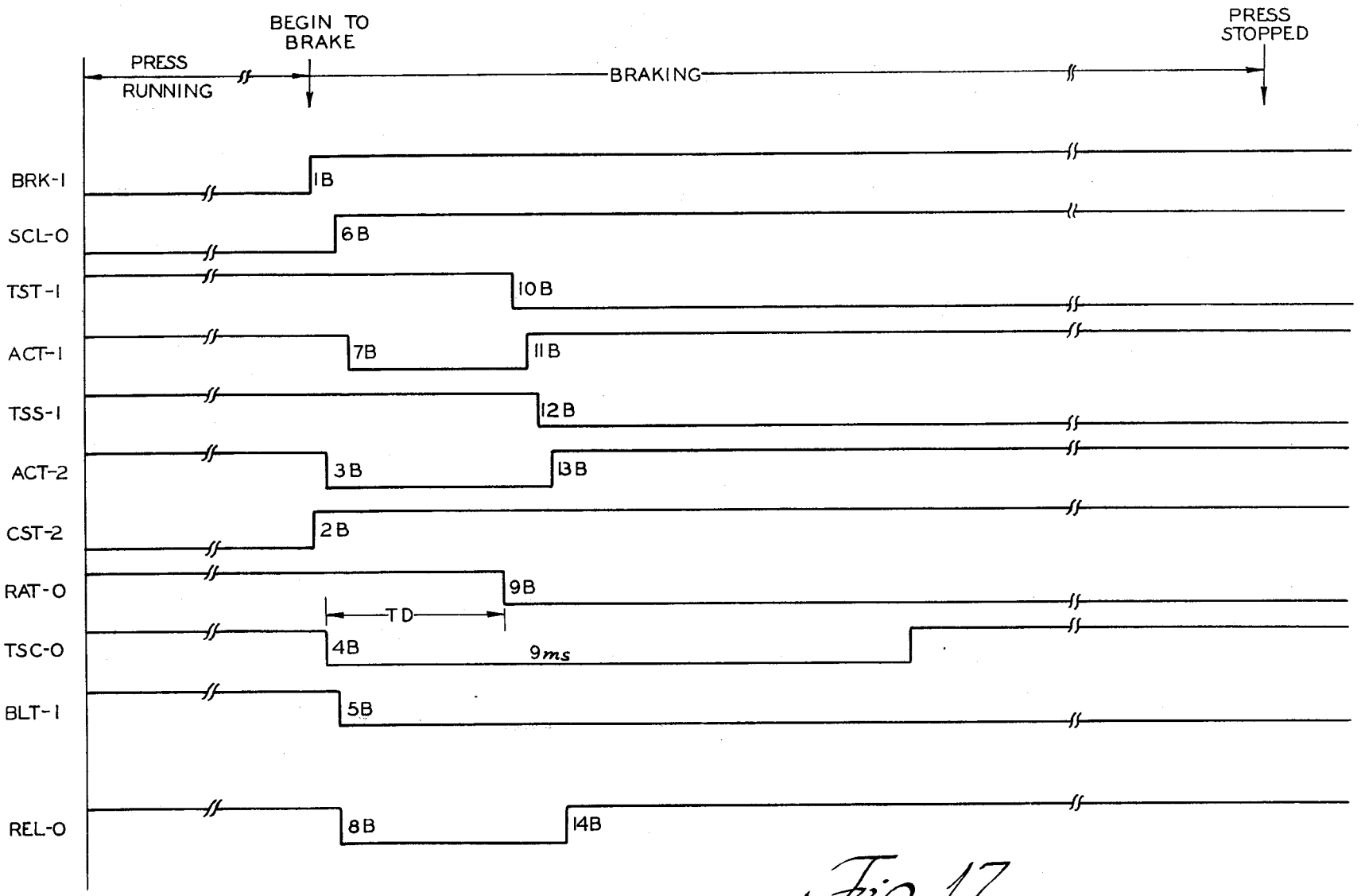
Figure 18:
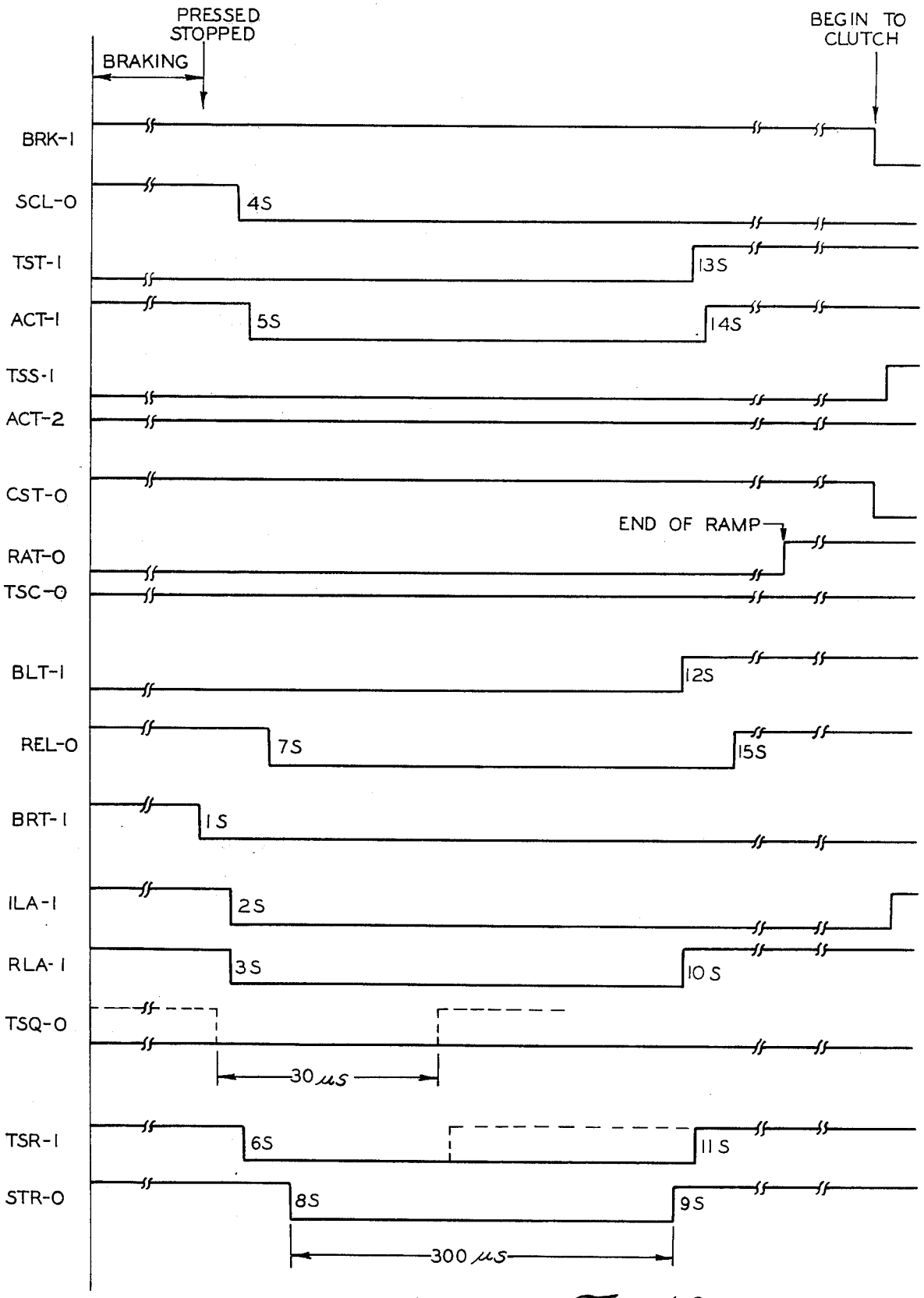
Figure 19:
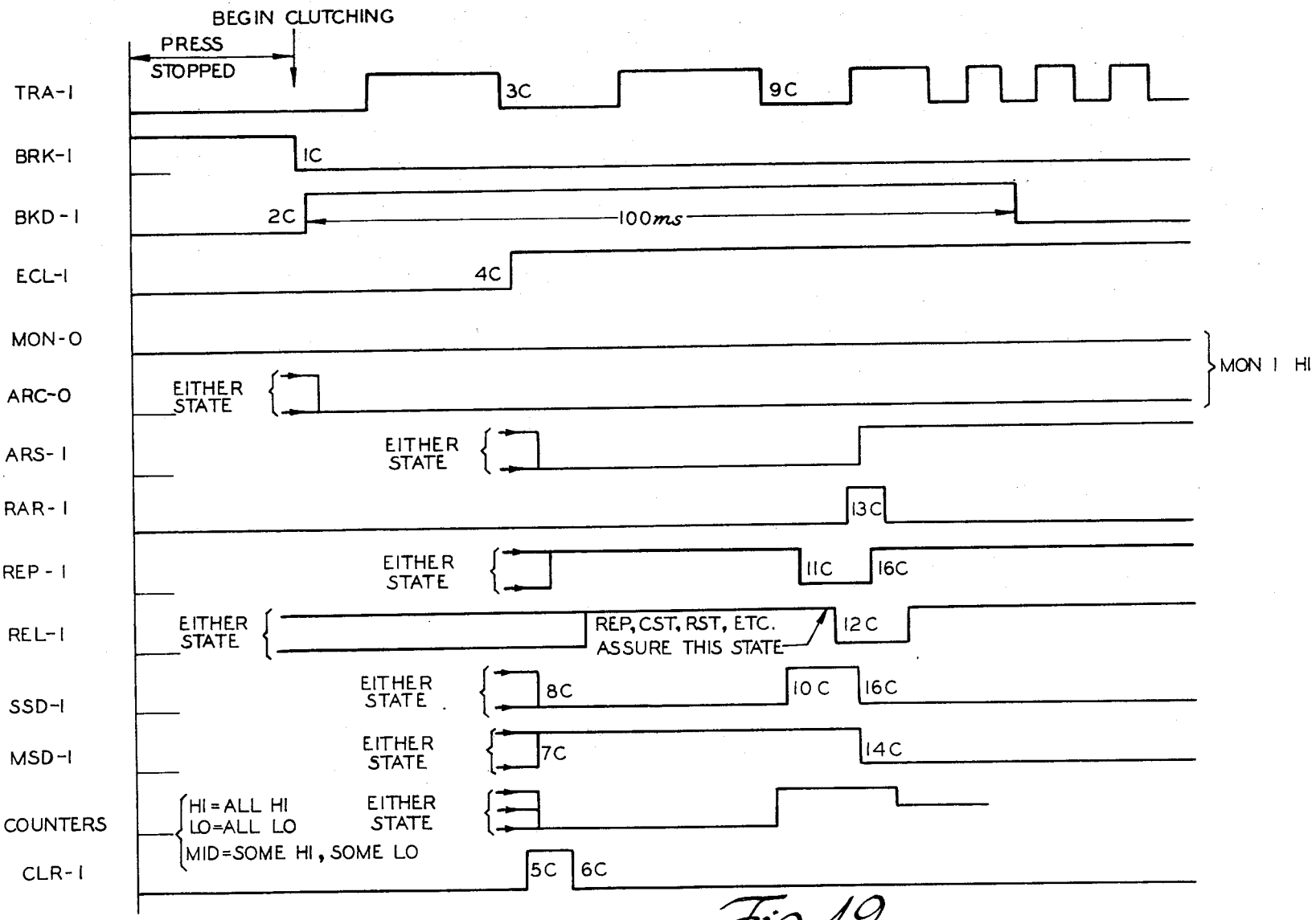

FIGS. 6*a* and 6*b* show the circuit of the basic monitor of this invention;

FIG. 7 shows the encoder signal circuit;

FIG. 8 shows the clutch-brake signal circuit;

FIG. 9 shows the reset generator circuit;

FIG. 10 shows the motion stop detector;

FIG. 11 shows the latch circuit;

FIG. 12 shows the relay check circuit;

FIG. 13 shows the self-check clearing circuit;

FIG. 14 shows a certain self-check circuit;

FIG. 15 shows the counter for crank position measurement and certain self-checking;

FIG. 16*a* and 16*b* show a preferred embodiment of the monitor with self-checking;

FIG. 17 is a timing diagram showing signal relationship during braking;

FIG. 18 is a timing diagram showing signal relationship upon stopping of the machine; and FIG. 19 is a timing diagram showing signal relationship during clutching.

An illustrative embodiment of the invention will now be described with reference to the drawings.

TYPICAL PUNCH PRESS AND CONTROL SYSTEM

Figure 1:
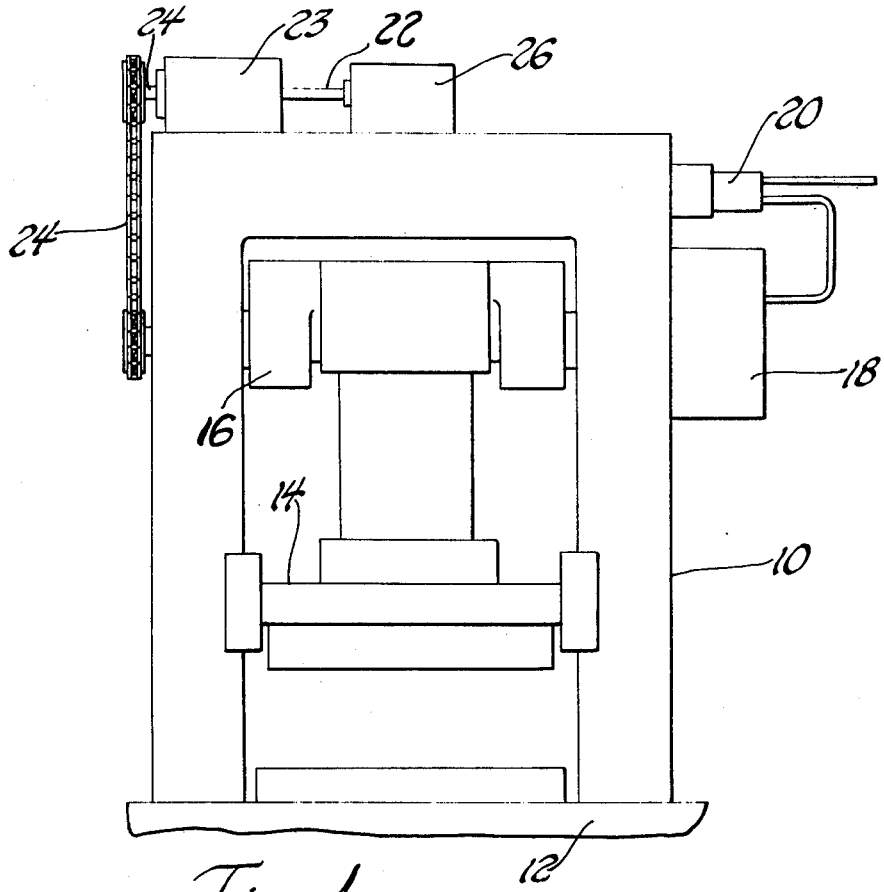
FIG. 1 depicts a typical press with the subject invention installed thereon.

The brake monitor of this invention will be described with reference to a typical application on a conventional punch press. A punch press as shown in FIG. 1 comprises a frame 10 with a bed 12 for receiving a die. A slide 14 is actuated in a reciprocating motion in the frame 10 by a crank 16 of a crankshaft journaled in the frame. A clutch-brake unit 18 coacts with the crankshaft and is controlled by a solenoid actuated air valve 20 for selectively braking the crankshaft or clutching it to the prime mover of the press. The press is also provided with a cam shaft 22 which actuates a set of cam actuated switches 23 in synchronism with the crankshaft through a chain and sprocket drive 24. A shaft position encoder 26, which forms a part of the brake monitor, is suitably mounted on the press and is driven in synchronism with the crankshaft, suitably through the cam shaft 22.

Figure 2:
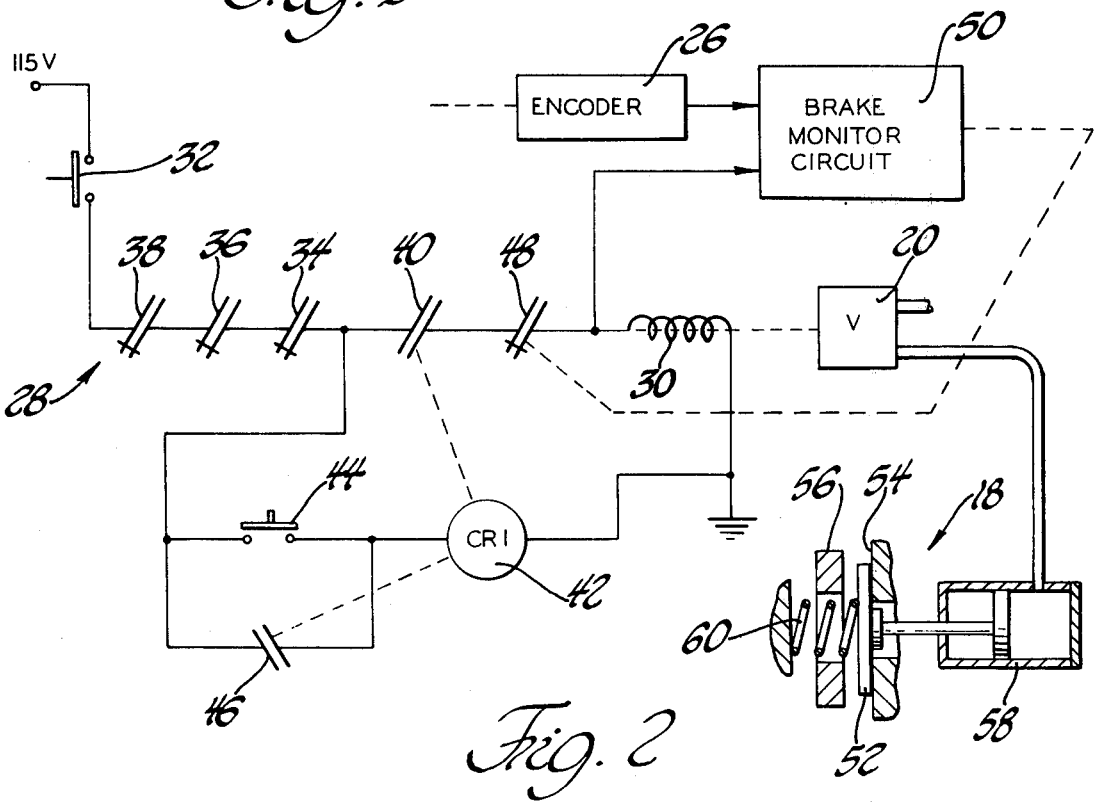
FIG. 2 is a control circuit or press incorporating the subject invention.

FIG. 2 is a schematic representation of a typical punch press control circuit with the brake monitor of this invention shown in block diagram. The conventional portion of the control circuit comprises a series circuit 28 connected across a supply voltage source and including the solenoid winding 30 of the solenoid valve 20. The series circuit includes a power on-off switch 32 for energizing the control circuit. It also includes a series of normally closed switch contacts, namely, top-stop contacts 34, die protection contacts 36 and pinch-point intrusion contacts 38. The series control circuit 28 also includes normally open starting switch contacts 40 which are actuated by a control relay 42 which is momentarily energized by a manual start switch 44. A set of holding contacts 46 are also actuated by the control relay 42 and maintains the relay 42 energized after the start switch 44 is released. The series control circuit 28 also includes normally closed, safety interrupt contacts 48 which are controlled by the brake monitor circuit 50 in a manner to be described subsequently. The clutch-brake unit 18, shown in schematic fashion in FIG. 2, is an air pressure clutch and a spring applied brake. It comprises a disc 52 which is drivingly connected with the crankshaft of the press and is also axially shiftable between engagement with the fixed brake member 54 and the driving clutch member 56 which is rotatably driven by the prime mover of the press. An air cylinder 58 actuates the disc 52 to engage the clutch and works in opposition to a brake spring 60 when air pressure is admitted to the cylinder through the solenoid valve 20. When the air pressure is dumped from the cylinder through the valve 20, the clutch is disengaged and the brake is applied by the brake spring 60.

As shown in FIG. 2, the brake monitor circuit 50 obtains two input signals from the press and in response thereto controls the actuation of the safety interrupt contacts 48. One of the input signals is derived from the encoder 26 and represents the motion of the crankshaft of the press. The other of the input signals is derived from the solenoid valve control circuit and signifies initiation of brake application to stop the press or clutch engagement to start the press.

The typical punch press is provided with controls which enable the operator to select different modes of press operation by selector buttons on the control panel of the press. The control means are well known and will not be described herein; however, different modes of operation will be identified to the extent they are relevant to the monitor circuit of this invention. The single stroke mode of operation is characterized by actuation of the press slide through a single cycle in response to a single actuation of the start switch. In single stroke operation, the cycle starts with a slide in the top-stop position, i.e. with the crank approximately in its top dead center position, and closure of the start switch causes the crankshaft to rotate one full revolution and come to a stop. The press may be operated at different speeds according to a speed control adjustment and the speed is given in strokes per minute, as if there were no idle time or stopping time between cycles. For example, a press operating at 60 strokes per minute in the single stroke mode makes one stroke per second but there may be long intervals of a minute or so between strokes when the press is idle. In the single stroke mode, the clutch-brake is actuated to engage the clutch upon closure of the start switch and it is actuated to disengage the clutch and apply the brake by the top-stop switch 34. This top-stop switch is actuated by the cam shaft of the cam switches 22 at a rotary position of the crank which will allow the brake to bring the crank to a stop near its top dead center. The crank position at which the top-stop switch is actuated is suitably adjusted in accordance with the operating speed of the press and other factors which affect the slide travel or crank rotation after the switch is actuated. In the single stroke mode of operation, the press is provided with an anti-repeat function which prevents the crank from executing a second cycle or stroke even though the operator holds the start switch closed throughout the first stroke. Consequently this feature requires that the operator release the start switch after initiating the first stroke and push the switch again to initiate the second stroke.

Another operating mode for the press which may be selectable by the operator is the continuous operation of the press. This is characterized by operation of the crankshaft through an uninterrupted sequence of cycles, i.e. with no idle time between strokes. The continuous mode of operation is initiated by actuation of the start switch and the press may be stopped by actuation of a top-stop switch on the control panel. An additional operating mode is called the inch mode which enables the operator to stop the slide at any desired position. In this mode the motion of the crank is initiated by actuation of the start switch and the motion is stopped when the switch is released.

The brake monitor of this invention is adapted to be operative when the press is operated in the single stroke mode. In this mode the press is operated with periodic or repeated stops with the slide at the top position and each stop presents an opportunity to test the effectiveness of the brake.

FUNCTIONAL CAPABILITIES OF THE BRAKE MONITOR

In operation of a press in the single stroke mode, the stopping of the press by brake application in normal operation will occur as either a top-stop or as a safety stop. The stopping distance, i.e. the slide travel or crank rotation after the brake signal, will vary with the angular position of the crank at the time of the brake signal. This, of course, follows from the fact that the crankshaft will have a larger angular momentum during the downstroke than it has during the upstroke. Accordingly, the stopping distance for a top-stop which is brought about mostly during the upstroke will be less than that for a safety stop which is brought about mostly during the downstroke. A safety stop may be initiated, for example, by actuation of the pinch-point intrusion contacts 38 or by the die protection contacts 36. A stop initiated by these contacts can occur at any point in the cycle of the crankshaft; the stopping distance will generally be greatest if the safety stop is initiated with the crank at the 90° position (measured clockwise from the top dead center) and will be at a minimum if it is brought about during the upstroke.

For a given press operating at a given speed the stopping distance for a top-stop will not exceed a predetermined value, provided that the brake is in normal operating condition. This stopping distance is suitably established by measurements performed on the press in its normal single stroke operation. When a brake is defective or abnormally worn, the stopping distance will exceed the predetermined value and operation of the press will be hazardous to the operator and should be shut down. The same press being operated at the same speed and with the brake in the same condition, will require a larger stopping distance for a safety stop which is brought about on the downstroke. If the stopping distance for the safety stop exceeds a second and higher predetermined value, press operation may be hazardous and it should be shut down. Further, if the crankshaft comes to a top-stop after top dead center by more than a predetermined angle, called the overrun anti-repeat limit, the press operation is hazardous and should be shut down.

Figure 3:
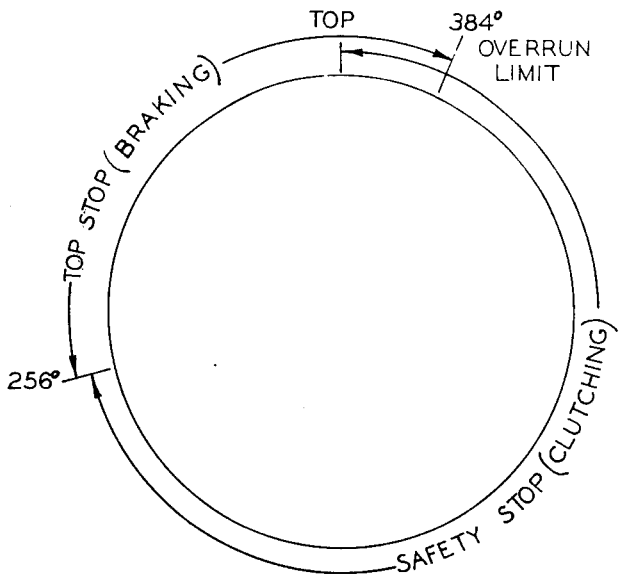
FIGS. 3, 4 and 5 are graphical illustrations to aid in explanation of this invention.

Although brake performance may be measured in terms of stopping distance, as alluded to above, it is most practical to measure brake performance in terms of stopping time which may be translated to stopping distance. Further, it is desirable to classify the stopping of the press as either a top-stop or a safety stop even though a safety stop could occur in the top-stop region and have a stopping time no greater than a top-stop This classification, as shown in FIG. 3, defines a safety stop as any stopping of the press where the crank comes to rest within a first angular range and defines a top-stop as any stop where the crank comes to rest within a second angular range. For the particular example represented by FIG. 3, the safety stop range (sometimes called 90° stop) extends from the top dead center to 256°. The top-stop range extends from 256° to 384°. Additionally FIG. 3 illustrates the overrun anti-repeat limit at the angular position of 384°.

Figure 4:
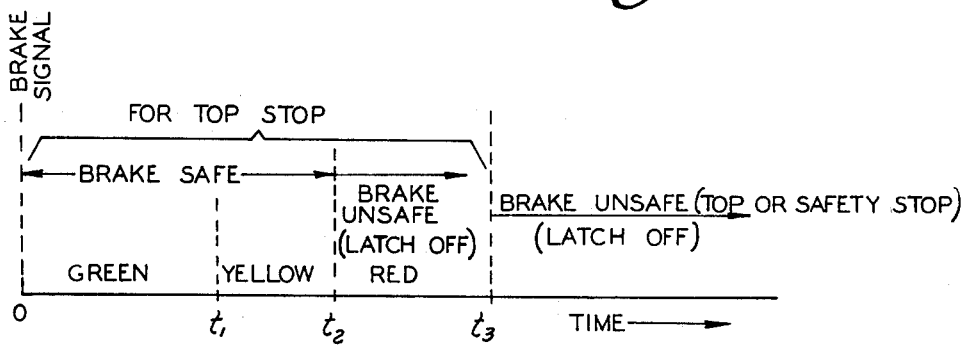

In order to monitor the braking performance of the press, the stopping time is measured upon every occurrence of a brake signal whether the signal is produced by the top-stop switch or a safety switch. This monitoring of the brake performance is adapted to provide a display to the operator which depicts the brake condition and, in addition, to shut down the press if a hazardous condition exists. The display and control functions are illustrated in the time diagram of FIG. 4. In this diagram, time is measured from the occurrence of the brake signal. If the stopping time is less than *t*1, the brake is in normal condition which is signified by a green light display. If the stop occurs before time *t*2 but after time *t*1 the brake condition is within the normal range but the operator is warned by a yellow light display that it is getting near the limit of normal condition. If the stopping time for a top-stop exceeds time *t*2 the brake is unsafe and the machine will be shut down and a red light will be displayed. If a safety stop occurs, the same display will be given as described for a top-stop provided that the stopping time is less than time *t*3. However, if the stopping time for a safety stop is greater than *t*2 but less than *t*3 the machine will not be shut down. If the stopping time exceeds *t*3 for a safety stop the press will be shut down.

THE BASIC MONITOR CIRCUIT

The monitor circuit, in its most essential aspect, is adapted to measure the stopping time of the press crankshaft and indicate whether it is satisfactory. As indicated above, the monitor circuit of this invention actually has the capability of performing more elaborate functions; in particular, it (1) measures the stopping time for each top-stop, (2) measures the stopping time for each safety stop, and (3) detects overrun of the anti-repeat limit stop. Additionally, it provides a display indicative of the braking performance and shuts down the machine in case of a hazardous condition. Also, as alluded to above, the monitor is provided with self-checking functions which determine whether there is any malfunction within the monitor (or within certain parts of the press control system) which would result in a false measurement display or control by the monitor and, if so, shuts down the press; i.e. latches it off.

For purposes of clarity, the monitor will be described first without inclusion of the self-checking functions. In that form, the monitor is referred to as the "basic monitor circuit". Subsequently the entire monitor system will be described with the inclusion of self-checking functions and other circuits which constitute the preferred embodiment of the invention.

GENERAL ARRANGEMENT

As indicated above, the basic monitor circuit measures the stopping time in response to two signals which are derived from the press, namely, a clutch-brake initiation signal and a crankshaft motion signal. With this input signal information, the monitor circuit determines the actual stopping time in relation to a predetermined time *t*1 and a predetermined time *t*2, both of which are established for the particular press and given operating parameters. If the stopping time is less than *t*1 the brake monitor will display a green light, signifying normal braking; if the stopping time is greater than *t*1 but less than *t*2 it will display a yellow light which signifies normal braking but approaching the limit of acceptability. If a top-stop is being executed and the stopping time is greater than *t*2, the monitor shuts down the press and displays a red light, signifying a hazardous condition. If the stopping time is greater than *t*3 for either a top-stop or a safety stop, the monitor shuts down the press.

Referring to FIGS. 6*a* and 6*b*, the monitor circuit will be described in general terms. It comprises a clutch-brake signal circuit 100 which supplies a brake signal in response to initiation of braking action. The clutch-brake signal circuit coacts with a timing circuit or integrater 102 to establish a time base or ramp voltage for measuring the time required for the crankshaft of the press to come to a stop. For the purpose of relating the stopping time, i.e. the elapsed time after the brake signal, to the predetermined times *t*1 and *t*2, a level detecting or threshold stage 104 is provided. The threshold stage 104 produces an output indicative of the braking time relative to *t*1 and *t*2 and the output is supplied to a memory stage 106.

The integrator 102 and the level detector stage 104 together with a stop time limit detecting circuit 193 comprise a measurement circuit 600 (see dashed line block, FIG. 6*a*). The limit detecting circuit produces a signal to shut down the press whenever the stopping time exceeds the predetermined time *t*3.

The purpose of the memory stage is to store the braking time information which exists at the instant when the press comes to a stop. For this purpose the encoder 26 produces a crankshaft motion signal which is applied to an encoder signal circuit 108 which, in the preferred embodiment, is a pulse forming circuit with pulse spacing or intervals corresponding to the rotational speed of the crankshaft. The output of the signal circuit 108 is applied to the input of a motion stop detector 110 which produces an output signal level transition at the time the speed falls below a predetermined value. The output of the motion stop detector is used to strobe the memory stage 106 and cause it to store the stopping time information.

The output of the memory stage 106 is applied to a display circuit 112 which includes display means for indicating the condition of the brake. The output of the memory stage is also applied through a logic circuit 114 to a relay circuit 116 which is adapted to shut down the press when a hazardous condition is signified by the stopping time measurement.

The Timing Circuit Integrator

The circuit for measuring the stopping time of the press will now be described in detail with reference to FIGS. 6*a* and 6*b*. For the purpose of developing a time base for measurement of stopping time, the timing circuit or integrator 102 is provided to develop a linear ramp voltage. The timing circuit or integrator 102 comprises an operational amplifier 120 having its reference input connected to ground and having an adjustable signal voltage applied to its signal input. The signal voltage is developed from a fixed voltage source $v_{13}$ which is applied through a variable resistor 122 and through an operational amplifier 124 and a resistor 126 to the signal input of the amplifier 120. The output of the amplifier 120 is connected through a feedback comprising an integrating capacitor 128 and resistor 130 to the signal input. In order to control the on-off time of the integrator 102, a switching transistor 132 in the form of a field effect transistor (FET) is connected across the integrating capacitor 128 and resistor 130 through a resistor 134. The field effect transistor is controlled by the output signal BRK-1 of the clutch-brake signal circuit 100 which is connected to the gate of the field effect transistor. When the clutch-brake signal BRK-1 goes high it signifies application of the brake and the switching transistor 132 is turned off to start operation of the integrator 102.

In operation of the integrator 102, the output 138 of the integrator will remain low so long as the brake signal BRK-1 is low which holds the switching transistor on and shorts out the integrating capacitor 128. When the brake signal goes high the switching transistor 132 is turned off and the output 138 of the integrator produces a ramp voltage 140 which increases linearly with time, as indicated by the wave form diagram adjacent the integrator output 138. The slope of the ramp voltage is determined by the magnitude of the input signal voltage applied to the operatonal amplifier 120 and is increased by decreasing variable resistor 122. Since the voltage level of the ramp produced by the integrator varies linearly with time, the value of voltage represents the elapsed time from the initiation of the ramp.

LEVEL DETECTING STAGE

In order to compare the stopping time with the predetermined values of elapsed time *t*1 and *t*2, the value of the ramp voltage 140 is compared with preset voltage levels in the level detecting stage 104. The level detecting stage comprises a pair of comparators 142 and 144, both of which have their signal inputs connected with the output 138 of the integrator through a resistor 146. Reference voltages are developed by means of a potentiometer 148 and a voltage divider connected with the potentiometer and including resistors 150, 152 and 154. A reference voltage *v*1 is developed at the junction of resistors 152 and 154 and is applied to the reference input of the comparator 142. A reference voltage *v*2 is developed at the junction of resistors 150 and 152 and applied to the reference input of the comparator 144. The comparator 142 develops a signal YCP-1 at its output which is connected through a resistor 158 to an input of the memory stage 106; similarly, the comparator 144 develops a signal RCP-1 at its output which is applied through a resistor 162 to an input of the memory stage 106.

Figure 5:
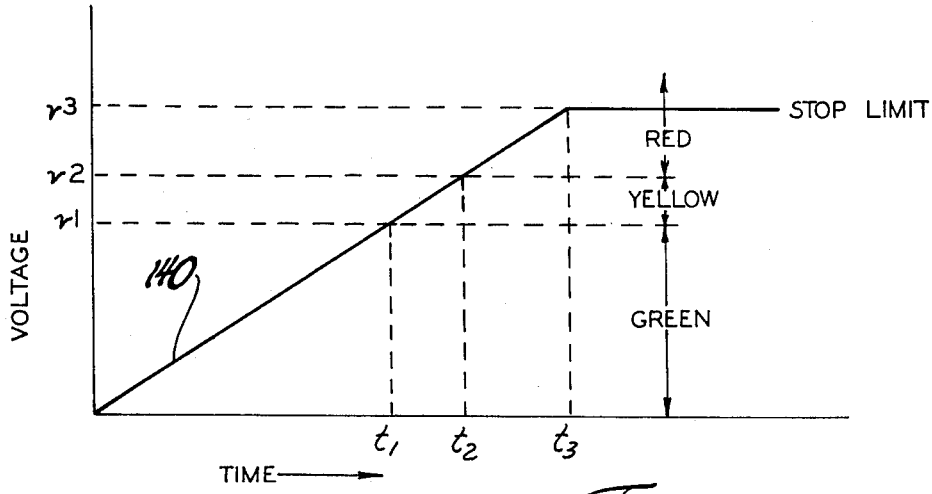

The operation of the level detecting stage 104 is as follows. When the ramp voltage 140 is at a valve less than *v*1 the output signal YCP-1 of the comparator 142 is high and the output signal RCP-1 of the comparator 144 is high. When the ramp voltage is higher than *v*1 but less than *v*2 the output signal YCP-1 is low and the output signal RCP-1 remains high. When the ramp voltage exceeds the voltage *v*2 the output signal RCP-1 goes low. This relationship is illustrated in FIG. 5 wherein the ramp voltage 140 is shown as a function of time and the reference voltages *v*1 and *v*2 are represented as constant values in relation to the ramp voltage. Also, as shown in FIG. 5, the stopping time *t*1 corresponds with the voltage *v*1 and the stopping time *t*2 corresponds with the voltage *v*2. (Stopping time *t*3 and voltage *v*3 will be discussed later.) When the ramp voltage is less than *v*1 a green light is to be displayed; when it is greater than *v*1 but less than *v*2 a yellow light is to be displayed and, for a top stop, when it is greater than *v*2 a red light is to be displayed. The value of the ramp voltage in relation to *v*1 and *v*2 at the time the press comes to a stop is stored in the memory stage 106.

MEMORY STAGE

The memory stage 106 receives, from the level detector stage 104, logic signals indicative of the ramp voltage relative to the preset voltage levels *v*1 and *v*2 and memorizes the information at the time the press comes to a stop. The memory stage 106 comprises a flip-flop 162 and a flip-flop 164. The output signal YCP-1 of the comparator 142 is applied to the D input of the flip-flop 162 and the output signal of the comparator 144 is applied to the D input of the flip-flop 164. The motion stop detector 110 has an output signal BRT-O which is applied to the clock input of the flip-flop 162 and the clock input of flip-flop 164. The motion stop detector output signal BRT-O goes from a logical low to a logical high at the time the press speed falls below a predetermined value. The predetermined value is sufficiently small that, for all practical purposes, the crankshaft of the press may be considered to be stopped. The Q output of the flip-flop 162 produces a logic signal YLA-1 which has a logic state the same as the logic signal applied to the D input. Similarly, the Q output of the flip-flop 164 produces a logic signal RLA-1. The flip-flops 162 and 164 have their reset inputs connected to the reset circuit which applies a low reset signal at the beginning of each press cycle, thereby initially setting the Q outputs of the flip-flops to a logical high.

In operation of the memory stage 106 the logic signal YCP-1 is continuously applied to the D input of the flip-flop 162 and the logic signal RCP-1 on the output 160 is continuously applied to the D input of the flip-flop 164. When the press comes to a stop, as determined by detector 110, the signal BRT-O goes from low to high. This strobes the flip-flops 162 and 164. Accordingly, the logic signals YLA-1 and RLA-1 are switched and held in the logic states which existed at the time of strobing. The output logic signals YLA-1 and RLA-1 of the memory stage 106 are applied to the display circuit 112 and additionally are applied through the logic circuit 114 to the relay circuit 116.

RELAY CIRCUIT

The relay circuit 116 is adapted to shut down the press when the stopping time for a top-stop exceeds time *t*2 which is signified when the ramp voltage exceeds a preset voltage *v*2 before the press is stopped. The relay circuit does not shut down the press if the stopping time for a top-stop is less than *t*2. The relay circuit comprises a first relay 165 having a relay coil 166 and two sets of relay contacts 168 and 172. It also comprises a second relay 173 having a relay coil 174 and two sets of relay contacts 176 and 178. The relay coil 166 is connected in series with a driver transistor 180 and the relay coil 174 is connected in series with a driver transistor 182. In order to switch the driver transistors on or off, the relay circuit is provided with AND gates 184 and 186 having their outputs connected to the base of transistor 180 and AND gates 188 and 190 having their outputs connected to the base of transistor 182. The gates 184, 186, 188 and 190 are controlled in accordance with the stopping time signals from the memory stage 106 and selected additional signals, as will be described below.

LOGIC CIRCUIT AND COUNTER

Before proceeding further with the description of the relay circuit 116 it will be helpful to consider the logic circuit 114.

The logic circuit 114 comprises a first branch including an OR gate 195 which is adapted to cause the relays to drop out when the stopping time exceeds *t2*, for a top stop. For this purpose the signal RLA-1 from the memory flip-flop 164 is applied to one input of the OR gate 195. A counter 198 receives its input from the encoder 26 and develops a count corresponding to the angular position of the crank shaft of the press during each single stroke cycle. A signal TSP-1 from the counter 198 is applied to the other input of the OR gate 195. The signal TSP-1 is at logical low for a top stop and goes to logical high for a safety stop. The signal RLA-1 is at logical high when the stopping time is less than *t2* and goes to logical low when the stopping time exceeds *t2.* Accordingly, for a top stop with the stopping time less than *t2* the output signal TSR-1 of the OR gate 195 will be high; if the stopping time exceeds *t2*, the signal TSR-1 will go low. (It is noted that for a safety stop a signal TSR-1 will remain at logical high regardless of the stopping time.) The signal TSR-1 from the OR gate 195 is used to drop out the relays when it goes low. For this purpose the output of the OR gate is connected to one input of the AND gate 184 and one input of the AND gate 188. The other inputs of the AND gates 184 and 188 receive a signal REP-1 from the counter 198. The signal REP-1, for purposes of the present discussion, may be regarded as being continuously at a logical high throughout the single stroke cycle. (The signal REP-1 will be discussed later in connection with the anti-repeat overrun limit stop.) Accordingly, the output of the AND gates 184 and 188 will have the same logical state as the signal TSR-1 and will cause the relays to drop out when the stopping time exceeds *t2* for a top stop.

The logic circuit 114 is also adapted to cause the relays to drop out for shutting down the press when the stopping time exceeds *t3*, for both a top stop and a safety stop. For this purpose a second branch circuit is provided and includes an OR gate 196 which produces a signal ACT-1. A one-shot 192 receives the clutch-brake signal BRK-1. At the initiation of braking, the signal BRK-1 goes high and the one-shot produces a short pulse at its $\overline{Q}$ output. A flip-flop 194 has its reset input connected with the $\overline{Q}$ output of the one-shot and is reset upon the initiation of braking. This causes the output signal RBT-1 of the flip-flop at the Q output to go to logical low. The signal RBT-1 is applied to one input of the OR gate 196. The ramp signal RAT-O is applied to the other input of the OR gate 196 through an inverter 197. The signal RAT-O is at logical low when the stopping time is less than *t3* and goes to logical high when the stopping time exceeds *t3.* The output of the inverter 197 goes from logical high to low when stopping time exceeds *t3.* At the initiation of braking, the signal ACT-1 will be at logical high due to a high input to OR gate 196 from the inverter 197. The motion stop signal BRT-O is applied to the clock input of the flip-flop 194. The signal BRT-O goes high when the machine stops and this causes the signal RBT-1 to go to logical high. Thus the signal ACT-1 is maintained at logical high after the machine has stopped. However, if the ramp signal RAT-O goes high (signifying stopping time greater than *t3*) before the machine stops, the inverter 197 will go to logical low and the signal ACT-1 will go to logical low. The signal ACT-1 is applied to one input of the AND gate 186 and one input of the AND gate 190. Accordingly, when ACT-1 goes low the relays are dropped out and the machine is shut down.

LATCH

In order to prevent the monitor circuit from shutting down the press in response to unduly short duration signals, such as noise or other spurious signals, a latch 208 is provided. The latch has one input connected across the driver transistor 182 and another input connected across the driver transistor 180. The latch has an output 210 which is connected to one input of the AND gate 186 and to one input of the AND gate 190. The output signal LAT-1 of the latch 208 remains high unless either or both of the inputs goes low and remains low for a given interval, for example 5 milliseconds. If either transistor 180 or 182 is turned off, and hence the corresponding relay is dropped out, for more than five milliseconds, the signal LAT-1 goes low and stays low until it is manually reset.

MORE ON RELAY CIRCUIT

Reverting now to the relay circuit 116, the outputs of AND gates 184 and 186 are connected to the base of driver transistor 180. So long as the outputs of both AND gates 184 and 186 remain high the transistor 180 is turned on and the relay coil 166 is energized. This pulls in contacts 168 and 172 with the movable contacts against the lower fixed contacts. Similarly, so long as the outputs of the AND gates 188 and 190 remain high the transistor 182 will be turned on and the relay coil 174 will be energized. This pulls in the relay contacts 176 and 178 with the movable contacts in engagement with the lower fixed contacts. With the contacts 172 and 176 both pulled in, a circuit is completed therethrough to the solenoid valve circuit, as indicated in FIG. 6*b*. Note that the relay contacts 172 and 176 in FIG. 6*b* correspond to the control contacts 48, as shown in FIG. 2. It is further noted that with the relay contacts 168 and 178 pulled in the voltage source *v*12 is connected through the contacts to a supply conductor 212 for the display circuit 112 which will be described below.

Further, with regard to the relay circuit 116, in the event that the output of AND gate 184 or 186 goes low, the relay contacts 168 and 172 will drop out and will engage the upper fixed contacts, as illustrated. Similarly, if the output of AND gate 188 or 190 goes low, the relay contacts 276 and 178 will drop out and engage the upper fixed contacts, as shown. It will be understood, from the foregoing description, that AND gates 186 and 190 will go low in case of a top-stop with the stopping time in excess of *t2*, i.e. with the ramp voltage exceeding *v2.* (In this case, the signal ACT-1 will also go low provided that the ramp voltage does not exceed *v3.*) Accordingly, both transistors 180 and 182 will be turned off and the coils 166 and 174 will be deenergized and the relay contacts will all drop out. However, in case of a safety stop in which the stopping time is greater than *t2* but less than *t3*, i.e. the ramp voltage exceeds *v2* and is less than *v3*, the signal ACT-1 will be high and the outputs of AND gates 184 and 188 will be high thus keeping the relays energized with the contacts pulled in. In this case, since it is a safety stop, the outputs of the OR gate 206 will also remain high and the outputs of AND gates 186 and 190 will remain high. Thus the relays will remain energized and the contacts will remain pulled in. However, in the event that the stopping time exceeds *t*3, i.e. the ramp voltage exceeds *v*3, whether it is a safety stop or a top-stop, the signal ACT-1 will go low. If it is a top-stop the output of OR gate 206 will also go low.) Accordingly, ACT-1 will cause the output of AND gates 184 and 188 to go low and the relays 165 and 173 will drop out.

DISPLAY CIRCUIT

The display circuit 112 is adapted to produce a display which indicates the condition of the brake. For this purpose it includes a yellow signal lamp 220, a green signal lamp 222 and a red signal lamp 224. When the stopping time for the press is unduly long, either for a top-stop or for a safety stop, the relays 165 and 173 will be dropped out to deenergize the solenoid valve circuit and to energize the red signal lamp 224. With the relay contacts dropped out, as shown in FIG. 6*b*, the red lamp 224 is energized from the voltage source *v*12 through relay contacts 168 and 178 and thence through the lamp 224 to ground.

The display circuit 112 also comprises logic circuits for controlling the energization of the yellow lamp 220 and the green lamp 222. The logic circuits include an exclusive OR gate 226 having one input connected with the Q output of flip-flop 162 and having its other input connected with the Q output of the flip-flop 164. The output of the exclusive OR gate 226 is connected to the input of a Darlington pair of transistors 228 and 230 which are connected in series with the yellow lamp 220. The emitter of transistor 230 is connected to ground and the yellow lamp 220 is connected between the collectors of the transistors and the supply voltage conductor 212. When the stopping time for the press is greater than *t*1 but less than *t*2, the signal YLA-1 will be low and the signal RLA-1 will remain high. Accordingly, the output of the exclusive OR gate 226 will be high and the transistors 228 and 230 will be turned on. In this condition, the relays 165 and 173 will remain pulled in and the voltage source *v*12 will be connected through relay contacts 178 and 168 to the supply voltage conductor 212. According, the yellow lamp 220 will be energized.

When the stopping time of the press is less than *t*1, both logic signals YLA-1 and RLA-1 will remain high and accordingly the output of the exclusive OR gate 226 will be low. This will maintain transistors 228 and 230 turned off and the yellow lamp 220 will be turned off.

The display circuit also includes a Darlington pair of transistors 232 and 234 for controlling the energization of the green signal lamp 222. The base of transistor 232 is connected to the Q output of the flip-flop 162. The emitter of transistor 234 is connected to ground. The green signal lamp 222 is connected between the collector of transistor 234 and the supply voltage conductor 212. When the stopping time of the press is less than *t*1, both logic signals YLA-1 and RLA-1 remain high. The signal YLA-1 is applied to the transistor 232 and the transistors 232 and 234 are turned on. In this condition, the relays 165 and 173 remain pulled in. Accordingly, the voltage source *v*12 is applied through contacts 178 and 168 to the supply voltage conductor 212 to energize the green signal lamp 222.

STOP TIME LIMIT DETECTING CIRCUIT

When the stopping time exceeds a predetermined limit, it is desirable to shut down the press whether a top-stop or safety stop is being executed. For this purpose, the limit detecting circuit 193 is provided. This circuit comprises a voltage limiter including a Zener diode 240 connected between the output 138 of the amplifier 120 and ground through a diode 242. The voltage limiter is effective to limit the value of the ramp voltage 140 to a value *v*3 established by the breakdown voltage of the Zener diode, suitably in the neighborhood of 10 volts. The limit detecting circuit also includes a differentiator stage comprising a transistor 244 which has its input connected to the output of the amplifier 120 through a differentiating capacitor 246 and resistor 248 having a diode 250 in parallel therewith. The output of the transistor is connected across a capacitor 252 and a negative feedback loop is provided through an inverter 254 and a capacitor 256. In operation of the limit detecting circuit, the transistor 244 will be turned off when the output of the amplifier 120 is held at a constant value. When the integrater produces the ramp voltage 140, the changing voltage across the differentiating capacitor 246 and resistor 248 will inject a current at the input of the transistor 244 causing it to switch on. Accordingly, the output of the transistor 244 at the collector will change from high to low at the initiation of the ramp voltage 140. However, when the ramp voltage reaches the limiting voltage *v*3 the Zener diode 240 conducts and the current supplied to the transistor 244 drops to zero and the output signal RAT-O goes high. The output signal RAT-O of the limit detecting circuit 193 has a waveform as indicated adjacent the transistor 244.

During the ramping period of the ramp voltage 140 (i.e. for time less than *t*3) from the integrater 102, the output signal RAT-O of the limit detecting circuit 193 is low. This signal is applied to the input of the inverter 197 and accordingly during the ramp period the output of the inverter is high. During the ramp period, as mentioned above, the output of the OR gate 196, namely, signal ACT-1 is high regardless of whether the machine is stopped as indicated by the state of signal RBT-1. However, at the end of the ramp period, i.e. when the voltage *v*3 is reached, the signal RAT-O goes high and the output of the inverter 197 goes low. This causes the signal ACT-1 from the AND gate 197 to go low unless the machine is already stopped causing signal RBT-1 to be high. When the ACT-1 goes low the outputs of AND gates 186 and 190 go low and the relays are dropped out, shutting down the press.

OVERRUN ANTI-REPEAT LIMIT

As discussed above, the basic monitor circuit is adapted to shut down the press in the event tht an operating cycle in the single stroke mode overruns the top-stop position by a predetermined angle. Such an overrun would indicate that a failure has occured in executing the top-stop by reason of a malfunction of the top-stop switch, the anti-repeat circuitry, or the like. The overrun anti-repeat limit is provided by the counter 198 which, as mentioned above, counts the encoder pulses from the beginning of each top-stop cycle and hence has an output count which represents the angular position of the crank of the press. Means are provided to clear the counter 198 and to initiate counting upon the receipt of a clutch signal and an incoming encoder pulse in that order, as will be described more fully below. The counter 198 is adapted to produce an output signal REP-1 (mentioned above in connection with the logic circuit 144) which is continuously high from the beginning of the single stroke cycle through the predetermined overrun limit angular position, for example, from 0° through 384°. When the angle of rotation of the crankshaft exceeds the limit, say 384°, the signal REP-1 goes low. This output signal REP-1 of the counter 198 is applied to an input of AND gate 188 and an input of AND gate 184. Accordingly, when the anti-repeat overrun limit is exceeded causing the signal REP-1 to go low, the output of the AND gates 184 and 188 also go low and the relays are dropped out causing the press to be shut down.

ADDITIONAL SPECIFIC CIRCUITS OF THE BASIC MONITOR CIRCUIT

The basic monitor circuit is described above with certain circuits shown in block diagram in FIGS. 6*a* and 6*b*. These circuits will be described in detail below.

ENCLODER SIGNAL CIRCUIT

As described above, an encoder 26 is driven synchronously with the crankshaft of the press for the purpose of developing signals indicative of the speed and angular position of the crank. The encoder 26 is suitably of conventional construction and preferably comprises an electro-optical shaft encoder which produces a train of output pulses in which the pulse width and pulse spacing are equal; each pulse and each space represents equal angular increments of rotation of the shaft. The output pulse train of the encoder 26 is applied to the input of an encoder signal circuit 108 which will be described below.

The encoder signal circuit 108 is shown schematically in FIG. 7. The signal circuit is adapted to accept the output of the encoder 26 and produce a pulse train having a narrow pulse corresponding to each of the leading and trailing edges of the pulses produced by the encoder. Thus, for an encoder which produces one pulse per degree of rotation of the crankshaft of the press, the encoder signal circuit 108 will produce two pulses per degree of rotation or 720 pulses per revolution. For this purpose the encoder signal circuit comprises a transistor 260 having its input connected with the output of the encoder 26 and its output connected through a conductor 262 to one input of an exclusive OR gate 264. A transistor 266 has its input connected with the output of the transistor 260 through a pair of resistors 268 and 270 having a shunt capacitor 272 therebetween. The output of the transistor 266 is applied to the other input of the exclusive OR gate 264. The resistors 268 and 270 and the capacitor 272 form a delay line which produces a phase shift between the output of the transistor 266 and the output of transistor 260. This phase shaft corresponds in magnitude to a small fraction of the width of the encoder pulses at low press speeds and is suitably of a time delay of about 30 microseconds. The output of the exclusive OR gate 264 is applied through an inverter 274 to produce the encoder signal ENC-1 at the output of the encoder signal circuit.

In operation, the transistor 260 produces a transducer output signal TRA-O which is an amplified and inverted version of the output of the encoder 26. The transistor 266 produces a transducer output signal TRA-1 which is an inverted and time delayed version of the output of transistor 260. These signals are represented by the waveforms adjacent the input of the exclusive OR gate 264. The exclusive OR gate has a low output when the input signals are the same and it has a high output when the input signals are different. Accordingly, the exclusive OR gate produces a train of narrow pulses with each pulse having a width corresponding to the time or phase delay between the output signals TRA-0 and TRA-1 having a pulse spacing corresponding to the width of the output pulses from the encoder 26. The output signal ENC-1, having a waveform as indicated adjacent the inverter 274, is applied to the input of the motion stop detector 110.

CLUTCH-BRAKE SIGNAL CIRCUIT

The purpose of the clutch-brake signal circuit is to signal the logic circuitry when the clutch is engaged and when the brake is applied. it is noted in the clutch-brake arrangement mentioned above, the deenergization of the air valve solenoid initiates the disengagement of the clutch and the initiation of the brake application. Although there is a small time delay between clutch disengagement and brake application, the energization of the air valve solenoid is a suitable signal to indicate clutch engagement and the deenergization of the solenoid is a suitable signal to indicate brake application.

The clutch-brake signal circuit is shown in FIG. 8. The input signal is derived from the terminals of the air valve solenoid and this signal is applied across the input terminals of a full wave rectifier 280. The output of the rectifier 280 is applied through a differential time constant circuit 282 to the input of a transistor 284. The time constant circuit will be described below. The output of the transistor is applied through an inverter 286 and a resistor 288 in a positive feedback loop to the input. The output of the transistor is also applied to one input of an AND gate 290. The other input of the AND gate 290 receives a reset circuit which will be described below. The AND gate 290 produces clutch-brake signal BRK-1.

It has been found that special provision is required to prevent undesired response to erratic pulse such as those produced by contact bounce of the press starting contacts. An undesired response of the clutch-brake signal circuit to contact bounce causes the clutch-brake signal BRK-1 to go to logical low. This signal is used to cause the initiation of the clutching and running mode of operation of the monitor and self-checking circuits. As discussed above, the monitor circuit depends upon pulses from the encoder to perform its function; if an encoder pulse is not produced within a certain time after the initiation of clutching, the press should be shut down. A self-check circuit will be described below which receives the clutch-brake signal and which allows a certain time depending upon press characteristics, for example 100 milliseconds, for receipt of an encoder pulse. If a momentary clutch-brake signal is produced, as by contact bounce, the clutch will not respond fast enough to accelerate the crank. Contact bounce pulses are typically about 10 milliseconds or less duration. There will be no encoder pulse in the allotted time period and the self-check circuit will shut down the press and latch it off. To prevent this, the clutch-brake signal circuit is provided with the differential time constant circuit 282. The circuit couples the output of the rectifier 280 to the input of the transistor 284. It comprises a pair of series resistors 281 and 283 connected between the rectifier and the base of the transistor and a pair of shunt capacitors 285 and 287 connected from the junction of the resistors to ground. A diode 289 is connected in series with the capacitor 285 to allow it to be charged through resistor 281 and to prevent it from being discharged through resistor 283 and the input circuit of the transistor 284. A discharge resistor 291 is connected across the capacitor 285 to ground. It can be seen that capacitors 285 and 287 are effectively in parallel for a positive-going charging voltage at the output of the rectifier, as in the case of a clutching signal. Thus, for clutching, the circuit has relatively large time constant. Capacitor 285 is larger than capacitor 287, suitably by a factor of about 3. Resistors 281 and 283 are suitably equal in value and resistor 291 is much larger, suitably by a factor of about 10. For a negative-going voltage at the output of the rectifier, as in the case of a braking signal, the circuit has a relatively small time constant since capacitor 285 is blocked and only capacitor 287 discharges into the base of the transistor 284. The capacitor 285 discharges through resistor 291 during the off state, i.e. when the press is in a top stop with the rectifier output at zero voltage. The time constant of the circuit for braking, for example, is about 5 milliseconds and for clutching, about 20 milliseconds. The differential time constant causes the transistor to respond slowly to a positive-going voltage and hence pulses die to contact bounce will not cause a false initiation of clutching. On the other hand, the transistor will respond quickly to a negative-going signal, as for braking. This provides the accurate timing required for measurement of braking deceleration. Due to the cycle operating characteristics of the machine, the capacitor 285 is discharged once per machine cycle in the machine off-state and the circuit is ready for the next cycle.

In summary, when the air valve solenoid is energized, the full wave rectifier 280 produces an output voltage of positive polarity and the transistor 284 is turned on. Accordingly, the collector of the transistor is low. When the clutch solenoid is deenergized the input to the transistor 284 is low and the output is high. The reset signal RES-0 will be high with the press ready to run. Consequently, the AND gate 290 produces a low output signal BRK-1 when the clutch is engaged; when the clutch is disengaged, and hence the brake is applied, the output signal BRK-1 will be high.

RESET CIRCUIT

The reset circuit 300, as shown in FIG. 9, is provided to enable restarting of the press after the relays have been latched out and also to ensure that the logic circuits are initially set in a predetermined logic state on start-up. The reset circuit comprises a manual reset switch 302 which is connected with a time delay switching circuit. The time delay circuit comprises a capacitor 304 connected in series with a resistor 306 across a voltage source *Vcc* and a capacitor 308 connected in series with a resistor 310 across the voltage source. The ungrounded terminals of the capacitors 304 and 308 are connected together through a diode 312. The capacitor 304 and resistor 306 have a shorter time constant than the capacitor 308 and resistor 310 for reasons which will appear subsequently. A transistor 314 is adapted to produce a reset signal RST-0 and is switched on or off by a field effect transistor (FET) switch 316. The FET switch has its output connected across the input of the transistor 314 through a resistor 318. The gate of the FET switch is connected to the junction of resistor 310 and capacitor 308.

In operation, when the manual switch 302 is closed the capacitors 304 and 308 are quickly discharged. This causes the reset signal RES-0 to go low since it is connected directly to ground through the switch 302. It also causes the FET switch 316 to be turned off which causes transistor 314 to be turned on. With transistor 314 turned on the reset signal RST-0 is also set low. When the reset switch 302 is released and opened the capacitors 304 and 308 start to charge from the voltage source *Vcc.* The capacitor 304 will be charged up first because of the smaller time constant and the fact that the diode 312 blocks the charging current to capacitor 304 from being diverted to capacitor 308. After a predetermined time delay following the charging of capacitor 304 the capacitor 308 will be charged sufficiently so that the FET switch 316 is closed so that transistor 314 is turned off. When transistor 314 is turned off the reset signal RST-0 goes high. It is noted that when the reset switch 302 was opened the reset signal RES-0 immediately went high. Accordingly, the reset signals RES-0 and RST-0 go from low to high in that order when the reset switch 302 is opened.

THE MOTION STOP DETECTOR

The motion stop detector circuit 110, as mentioned above, produces an output signal level-transition at the time the speed of the press falls below a predetermined value, which for practical purposes is equivalent to stopping of the press. The motion stop detector is shown in FIG. 10. In the train of encoder pulses (signal ENC-1) from the encoder signal circuit 108, the pulses recur at increasingly greater time intervals as the press slows down. When the pulse interval becomes larger than a certain valve, say 5 milliseconds, the press will be regarded as being stopped. To detect this condition, the motion stop detector comprises a one-shot multivibrator 320 and an AND gate 322. The encoder signal ENC-1 is applied to one input of the AND gate 322. The other input of the AND gate 322 receives a logical signal from the Q output of the one-shot 320, and will be discussed further below. The output of the AND gate 322 is connected with the trigger input of the one-shot and when the gate 322 is open the output of the gate is the same as the encoder signal ENC-1. The one-shot 320 is triggered by a falling pulse, i.e. a high to low transition on its trigger input. When the one-shot is triggered the Q output will go to logical high and the $\overline{Q}$ output will go to a logical low. A brake time signal BRT-0 is developed at the $\overline{Q}$ output of the one-shot 320. The one-shot is provided with a timing circuit including a resistor 326 and capacitor 328 which holds the Q output at logical high for a preset time period after the one-shot is triggered. In particular, the preset period is established at the same value as the pulse interval in the encoder signal which corresponds to motion stopped, namely 5 milliseconds. Accordingly, when the pulses in the pulse train from the encoder signal circuit are closer than 5 milliseconds the one-shot 320 will produce a continuously high signal on its Q output and a continuously low signal on its $\overline{Q}$ output. When the pulse interval equals or exceeds 5 milliseconds the one-shot 320 will change state and the Q output will go low and the $\overline{Q}$ output will go high. Thus, the brake time signal BRT-0 is low with the press moving and goes from low to high when the motion of the press is nearly stopped.

As noted above, the Q output of the one-shot is connected with one input of the AND gate 322. When the Q output goes low, the gate is closed and the encoder signal ENC-1 is blocked from the trigger input of the one-shot. The AND gate 322 is initially opened by the clutch-brake signal BRK-1. For this purpose, the clutch-brake signal BRK-1 is applied to the clock input of the one-shot and to the clear input of the one-shot. When the clutch-brake signal goes from low to high upon the initiation of braking, the signal triggers the one-shot to start the operation of the motion stop detector by opening the AND gate 322.

LATCH CIRCUIT

In order to prevent the monitor circuit from shutting down the press in response to short duration signals, such as noise or certain self-checking signals, as will appear hereinafter, the latch 208 is provided. As mentioned above, the output signal LAT-1 of the latch 208 is high and remains high unless one or both of the driver transistors 180 or 182 is turned off and remains off for a given time interval, for example, 5 milliseconds.

The latch circuit 208 is shown in FIG. 11. It comprises a NOR gate 340, a one-shot multivibrator 342 and a bistable multivibrator 344. The NOR gate 340 has one input connected with a logic voltage source *Vcc* through a resistor 346 and also connected through a diode 348 to the collector of transistor 182. Similarly, the other input of the NOR gate 340 is connected with the logic voltage source through a resistor 350 and the input is also connected through a diode 352 to a collector of transistor 180. The output of the NOR gate 340 produces a logic signal LCL-1 and is connected with the trigger input of the one-shot 342. The output of the NOR gate is also connected with the data input of the bistable multivibrator 208. The $\overline{Q}$ output of the one-shot 342 is connected with the clock input of the bistable 344. The one-shot 342 has a timing circuit 354 which sets the period of the one-shot at a desired time, for example 5 milliseconds. When the signal LCL-1 makes a transition from high to low it triggers the one-shot 342 and causes the $\overline{Q}$ output to go low and stay low for a period of 5 milliseconds. The bistable multivibrator 344 is clocked on a rising pulse at the clock input. When the signal LCL-1 goes low the bistable multivibrator 344 is set low by the signal on the data input D. Accordingly, if the signal LCL-1 remains low for 5 milliseconds or more the rising pulse at the clock input of the bistable multivibrator 344 will cause the output signal LAT-1 to be held low until it is manually reset. The bistable multivibrator 344 has the reset signal RST-0 applied through a diode 356 to the reset input R.

In operation of the latch circuit 208, the signal LCL-1 at the output of the NOR gate 340 will be high when both of the driver transistors 180 and 182 are turned on. If either or both transistors are turned off the signal LCL-1 goes from high to low. This triggers the one-shot 342 and the $\overline{Q}$ output thereof goes from high to low for a period of 5 milliseconds and than makes a low to high transition. The bistable multivibrator 344 has the signal LCL-1 applied to its data input; the Q output, namely signal LAT-1 is high when LCT-1 is high, that is when both driver transistors are conductive. However, when LCL-1 goes low and remains low for 5 milliseconds or more the rising pulse from the $\overline{Q}$ output of the one-shot 342 will clock the bistable multivibrator 344 and cause the Q output to go low and remain low until manually reset. If the signal LCL-1 goes low but remains low for less than 5 milliseconds, as in the case of one or both of the driver transistors being turned off for less than 5 milliseconds, the bistable multivibrator 344 would be clocked high and the output signal LAT-1 would remain high.

COUNTER FOR CRANK POSITION MEASUREMENT AND CERTAIN SELF-CHECKING.

During each operating cycle of the press, the angular position of the crank is registered by a crank position circuit 410 as shown in FIG. 15. This circuit is adapted to provide logic signals which indicate whether the press is in a top-stop position, a safety stop position, or whether the top-stop has failed resulting in overrun of the anti-repeat limit position.

The crank position circuit 410, in general comprises a set of counters 414, 416, 418 and 420. When clutching begins, i.e. when the brake signal BRK-1 goes low, the counters are set to zero and then count the transducer signal pulses TRA-1 as a measure of the position of the crank. The circuit includes an OR gate 422 which receives the output of the counters 418 and 420. The OR gate 422 produces a low output for a crank position in the top-stop region of 256° to 384°. This output signal TSP-1 is applied to an AND gate 424 which produces a signal TSQ-0. The signal TSQ-0 is applied to the logic circuit 500 (to be described below) and allows a logical low signal RLA-1 to shut down the press on a top-stop. The OR gate 422 has a high output signal TSP-1 for a crank angle in the safety stop region of zero to 256°. This changes the state of TSQ-0 and prevents a logical low signal RLA-1 from shutting down the press. Additionally, the crank position circuit produces an output which causes the signal REP-1 to go low and remain low when the crank has gone past 384° without receiving a top-stop signal. This indicates an overrun anti-repeat failure and shuts down the press.

The crank position circuit 410 will now be considered in greater detail. The transducer signal TRA-1 is supplied from the encoder signal circuit 108 to a one-shot 426 through an inverter 428. The output of the inverter is connected to the trigger input of the one-shot 426. The one-shot is triggered by a rising pulse, i.e., a low to high transition and the trigger input causes the Q output to go high. The output of the inverter 428 goes high when the signal TRA-1 goes low which occurs at the trailing edge of each pulse. The one-shot 426 has a time constant circuit 429 which causes the Q output to remain high for a given period, say 100 milliseconds, after the one-shot is triggered. The Q output of the one-shot 426 produces a stretched transducer signal ECL-1. In effect, the signal ECL-1 is high for 100 milliseconds after each transducer pulse. The stretched transducer signal ECL-1, as noted above in the description of the self-check circuit 400, is applied to the NOR gate 406 to signify that transducer pulses are being produced. The stretched transducer signal ECL-1 is also used for clearing the counters at the initiation of clutching. For this purpose, a one-shot 430 is provided and the signal ECL-1 is applied to the reset input. The clutch-brake signal BRK-1 which goes low at the initiation of clutching is applied to the trigger input of the one-shot 430. Accordingly, when clutching is initiated the trigger input will go low and subsequently when the first encoder pulse is produced the signal ECL-1 will go high causing the one-shot 430 to be triggered. In its triggered state the Q output produces a clear signal CLR-1 and the $\overline{Q}$ output produces a clear signal CLR-0. The one-shot has a time constant circuit 432 which holds the one-shot in its triggered state for a period of 3 milliseconds after triggering.

The clear signal CLR-1 is applied to the clear inputs of the counters 414 and 416. Accordingly, at the initiation of clutching and with the production of the first transducer pulse the counters are cleared in readiness for registering the angular position of the crank of the press.

The counters 414 and 416 are count-down counters and are, in effect, set to divide by 128. For this purpose the counter 414 has four operative binary stages and the counter 416 has three operative binary stages. The output of the inverter 428 is applied to the count input of the counter 414 and the $\overline{Q}$ output thereof is applied to the count input of the counter 416. Accordingly, the output of the counter 416 goes low for every 128th transducer pulse applied to the count input of the counter 414.

The output of the counter 416 is applied to the subsequent counter 418 which is a divide-by-2 counter. It produces a Q output signal SSD-1 which is low and remains low so long as the input on the input is high. When the input goes low, which occurs on every 128th encoder pulse, the Q output of the counter 418 goes high. The Q output will remain high during the next 128 encoder pulses after which the input will go low which will toggle the counter 418 so that the Q output goes low. In other words, the Q output signal SSD-1 of the counter 418 is toggled between low and high for every 128 encoder pulses with the output starting at the low state. Consequently, the $\overline{Q}$ output signal SSD-0 of the counter 418 will be alternately low and high for every 128 encoder pulses starting with a high state. The counter 420 is also a divide-by-2 counter and the $\overline{Q}$ output of counter 418 is connected with the count input of the counter 420. Counter 420 produces an output signal MSD-0 at its $\overline{Q}$ output. This signal MSD-0 will be high throughout the first 256 encoder pulses and will then go low and remain low throughout the next 256 encoder pulses. It is noted that the logic state of the output signal SSD-1 of counter 418 and the output signal MSD-0 of counter 420 are shown in tabular form on the drawing adjacent the respective counters.

The output signal SSD-1 of counter 418 and the output signal MSD-0 of counter 420 are applied to the inputs of the OR gate 422. The OR gate thus produces an output signal TSP-1 which has a logic state as shown in the table adjacent the OR gate. The OR gate 422 produces an output signal TSP-1 which is low when the crank position is in the range of 256° to 384° and it is otherwise high. This output signal is applied to one input of the AND gate 424. The other input of the AND gate 424 receives a signal TSN-0 which will be described subsequently. The output of the AND gate 424 produces a signal TSQ-0 which will be low when the crank of the press is in the top-stop region of 256° to 384°. This signal TSQ-0 is used in the logic circuit 500 to allow the signal RLA-1 to stop the machine and shut it down if there is a failure in making a top-stop.

A one-shot 458 receives the signal BRT-1 on its trigger input which causes its $\overline{Q}$ output signal TSN-0 to go low for 30 microseconds. The signal TSN-0 is applied to one input of the AND gate 424. This arrangement causes the signal TSQ-0 to be forced low for the time-out period of the one-shot 458. This enables a self-check cycle to be made at each machine stop time, as will be described below.

OVERRUN ANTI-REPEAT LIMIT

The output signals SSD-0 and MSD-0 of the counters 418 and 420, respectively, are also used to signify the occurrence of an overrun anti-repeat failure, i.e. when the crank of the press rotates through 384° or more during a single stroke cycle. For this purpose, the signal SSD-0 from counter 418 is applied to one input of an OR gate 436 and the signal MSD from counter 420 is applied to the other input of the OR gate 436. This OR gate produces an output signal REP-1 which is high from 0° up to 384° in which position it goes low and will remain low for the next 128°. This signal REP-1 from the OR gate 436 is applied to the relay circuit and when it goes low it shuts down the machine. It is also applied to an overrun anti-repeat failure indicator in the form of a light emitting diode 438 which is turned on when the signal REP-1 goes low.

RESET OF THE COUNTERS

It will be recalled from the description above that the Q output of counter 418 is to be low from 0° to 128° and the $\overline{Q}$ output of the counter 420 is to be high from 0° to 128°. Accordingly, it is necessary to reset the counters, at the beginning of clutching. The resetting is initiated when the clear signal CLR-1 goes high, which occurs after the clutch-brake signal BRK-1 goes low and the first tranducer pulse causes ECL-1 to go high. The signals CLR-1 and CLR-0 from the one-shot 430 are applied, as indicated in FIG. 15, to reset the counters to a count of 383°, i.e. one count short of the anti-repeat limit. The second transducer pulse, through the inverter 428, then increments the count to 384°. Accordingly, the signals SSD-0 and MSD-0 from the counters 418 and 420, respectively, should both go low and the output signal REP-1 of OR gate 436 should go low. (This is a self-check and if there is a malfunction the signal REP-1 will stay low long enough for the relays to drop out and shut down the machine.) In the absence of a malfunction, with REP-1 in the low state as just described, the signal REL-0 will also go low. Further, signal ABC-1 from NOR gate 444 will be low due to the high state of the signal BKD-1 at the beginning of clutch time (or due to the high state of the signal SNG-1 for continuous mode). This causes the output signal RAR-1 of the NOR gate 442 to go high which signifies that the self-check has passed satisfactorily. The signal RAR-1 is applied through the inverter 446 to the counter 420 and through the NOR gate 440 to the counter 418 to set the counters at 0 with the Q output of counter 418 low and the $\overline{Q}$ output of the counter 420 high.

OTHER SELF-CHECKING CIRCUITS FOR THE MONITOR CIRCUIT

Certain circuits, as described below, are adapted to perform self-checking functions in conjunction with the monitor circuit.

RELAY CHECK CIRCUIT

As part of the self-checking system for the monitor, a relay check circuit 360 is provided as shown in FIG. 12. The relay check circuit is adapted to determine whether the relay contacts of relay 165 are in a position corresponding to that of relay contacts of relay 173; in other words, whether relay contacts of both relays are pulled in at the same time or dropped out at the same time, as they should be if the relays operate properly. For this purpose, the relay check circuit comprises a capacitor 362 having a charging circuit including a pair of diodes 364 and 366 and a discharge circuit extending through resistors 368 and 370 to the negative terminal of a voltage source $V_{13}$. The diode 364 is connected between the upper fixed contact of the contacts 178 and the upper or nongrounded terminal of the capacitor 362. The positive terminal of a voltage source $V_{12}$ is connected to the upper fixed contact of the contacts 168. Accordingly, when the relays are both dropped out and hence are in the position shown in FIG. 10, the capacitor 362 will be charged from the voltage source $V_{12}$ through the relay contacts 168, relay contacts 178 and the diode 364. The diode 366 is connected between the lower fixed contact of contacts 168 and the upper terminal of the capacitor 362. Accordingly, when both relays are pulled in, i.e. with the movable contacts against the lower fixed contacts, the capacitor 362 will be charged from the voltage source $V_{12}$ through contacts 168 and the diode 366. In case one of the relays is pulled in and the other one is dropped out, no charging circuit is provided for the capacitor 362 since either contacts 168 or contacts 178 will interrupt the charging circuit. As a result, the capacitor 362 is discharged with a given time constant through the resistors 368 and 370. A relay check signal CON-1 is produced at the output 372 and will be high when both relays are pulled in together or dropped out together. The relay check signal CON-1 will be low when one relay is dropped out and the other is pulled in.

SELF-CHECK CLEARING CIRCUIT

In the self-checking function, a test is made by applying a relay dropout signal through selected circuits and determining whether both relay driver transistors respond properly to the dropout signal. If they do not respond properly, then the machine should be shut down. If they do respond properly then it is necessary immediately to turn on the transistors again before the relay contacts actually drop out. As will be appreciated, the speed of the electronic logic circuits is so much greater than the speed of the electromechanical relays that the driver transistors can be turned off and back on again before the relays actually drop out.

As shown in FIG. 13, the self-check clearing circuit 380 comprises a switching transistor 382 having an input circuit connected with the driver transistors 180 and 182. In particular, the input circuit includes a capacitor 384 having one terminal connected to ground and the other terminal connected through a diode 386 to the collector of transistor 180 and connected through a diode 388 to the collector of transistor 182. The ungrounded terminal of the capacitor 384 is also connected with the positive terminal of a logic voltage source $V_{cc}$ through a resistor 390. The ungrounded terminal of the capacitor 384 is also connected through a diode 392 to the base of the transistor 382. The base of the transistor 382 is connected to the negative terminal of a voltage source $V_{13}$ through a resistor 394. The output circuit of the transistor 382 includes a resistor 396 connected between the collector and the positive terminal of logic voltage source $V_{cc}$. The emitter of the transistor is connected to ground. The output 398 of the transistor produces a self-check clearing signal REL-0.

In operation of the self-check clearing circuit, the signal REL-0 is high when either of the driver transistors 180 and 182 is turned on and the signal will go low only when both transistors are turned off. When transistor 182, for example, is turned on the diode 388 will conduct current from the logic voltage source $V_{cc}$ and the junction 385 will be held at a potential above ground by one diode-drop plus the saturation voltage drop of the driver transistor 182. This voltage at junction 385 causes a current flow in the forward direction through the diode 392 to the negative terminal of the voltage source $V_{13}$. This produces a voltage drop across the diode 392 which puts the base of transistor 382 at the ground potential and the transistor is turned off. Accordingly, the signal REL-0 is high. This result will also be produced in case driver transistor 180 is turned on and also in case both driver transistors 182 and 180 are turned on. However, if both transistors are turned off, which causes both relays to begin to drop out, then neither diode 386 nor 388 are conductive and the capacitor 384 will be charged. This will cause the diode 392 to conduct and a forward bias voltage will be applied to the base of transistor 382 causing it to be turned on. With transistor 382 turned on the output signal REL-0 at output 398 will go low and remain low so long as both driver transistors are turned off.

SELF-CHECK CIRCUIT

When the press is running with the clutch engaged there should be a stream of transducer pulses and if not, the press should be shut down. Also if there is a stream of transducer pulses supplied to the monitor but there is no clutch-brake signal which signifies clutch engagement the press should be shut down. Further, if the relay check circuit 360 shows that one relay is dropped out while the other is pulled in, the press should be shut down. FIG. 14 shows a self-check circuit 400 for performing these functions.

The self-check circuit 400 comprises a one-shot 402, a first NOR gate 404, a second NOR gate 406 and an AND gate 408. The brake signal BRK-1 is applied to the trigger input T of the one-shot 402 and the Q output develops a time delay brake signal BKD-1 which is applied to one input of the NOR gate 404. The one-shot 402 is triggered on a high to low transition of the brake signal BRK-1 which causes the signal BKD-1 to go high. The one-shot 402 times out after a relatively long period, say 100 milliseconds. Accordingly, when the brake signal BRK-1 goes from high to low, which represents the initiation of clutching, the brake delay signal BKD-1 goes high and remains high for a period of 100 milliseconds and then goes low.

The clutch-brake signal BRK-1 is also applied directly to one input of the NOR gate 404 and, of course, the signal BRK-1 is high when the brake is applied and is low when the clutch is engaged. A stretched transducer signal ECL-1 is also applied to one input of the NOR gate 404 and is derived from a circuit to be described below. The stretched transducer signal goes high when the transducer signal TRA-1 goes high and remains high for a given period, say 100 milliseconds, after the signal TRA-1 goes low. The NOR gate 404 produces an output signal MON-O which will be low if any of the inputs are high; MON-O will be high only when all of the three inputs are low. The output of the NOR gate 404 is connected to one input of the NOR gate 406. A signal ARC-O, which is derived from a circuit to be described subsequently, is applied to the other input of the NOR gate 406. The output of the NOR gate 406 produces a signal MON-1 and is applied to one input of the AND gate 408. The other input of the AND gate 408 receives the relay check signal CON-1. The AND gate 408 produces a self-check signal ALM-1 which is high only when both input signals are high.

In operation, when the clutch-brake signal BRK-1 goes low signifying the initiation of clutching, the brake delay signal BKD-1 will go high and remain high for 100 milliseconds. The 100 millisecond delay gives the machine a chance to commence movement and produce the first transducer pulse causing the stretched transducer signal ECL-1 to go high and it will remain high for 100 milliseconds after the last encoder pulse is received. Consequently the signal ECL-1 will be continuously high so long as the transducer pulses are received and not spaced more than 100 milliseconds. If the clutch is engaged the signal BRK-1 will be low and 100 milliseconds after clutching the signal BKD-1 will go low. However, the signal ECL-1 being high will cause the output signal MON-O of the gate 404 to be low. With MON-O being low, and assuming that the signal ARC-O is low also, the NOR gate 406 will produce an output signal MON-1 which is high. If the relay check circuit signal CON-1 is also high, the output of the AND gate 408, namely signal ALM-1, will be high. However, if there are no transducer pulses during clutching the output of the NOR gate 404 will go high causing the output of the NOR gate 406 to go low and the self-check signal ALM-1 will go low and shut down the machine.

PREFERRED EMBODIMENT OF THE MONITOR WITH SELF-CHECKING

In the preferred embodiment of the monitor circuit, dynamic self-checking is performed at certain points in the operating cycle of the press. Additionally, certain self-checking is peformed on a continuing or static basis. The preferred embodiment is illustrated in FIGS. 16*a* and 16*b*. The basic monitor circuit is the same as that described with reference to FIG. 5 except for the logic circuit 114 in FIGS. 6*a* and 6*b*. In the preferred embodiment a modified logic circuit is utilized to accommodate the self-checking functions. The dynamic self-checking of the monitor circuit is performed with the press operated in the single stroke mode at three different points, namely; (1) at the initiation of braking, (2) at the stopping of the press, and (3) at the initiation of clutching.

The preferred embodiment of the invention will now be described with reference to FIGS, 16*a* and 16*b* in which the circuits previously described are represented in block diagram. The logic circuit 500 and the relay driver circuit 502 will be described presently.

THE LOGIC CIRCUIT OF FIG. 16*a*

It will be informative to describe the logic circuit 500 and at the same time describe its logic state with the press running in the single stroke mode before initiation of the braking. This logic state is depicted in the timing diagram of FIG. 17 under the heading "Press Running". The clutch-brake signal circuit 100 produces an output signal BRK-1 which is low until the brake signal is initiated. This signal BRK-1 is applied to the clear input of a one-shot 504 and sets the output signal STR-0 to logical high. The one-shot 504 is a strobe generator for the memory flip-flops 162 and 164 and the signal STR-0 is applied to one input of an AND gate 506. The other input of the AND gate 506 receives the output signal BRT-0 from the motion stop detector 110. The signal BRT-0 is high when the press is running and accordingly the gate 506 is open; the output of the gate 506 is high. The reset circuit 300 produces an output signal CST-0 which is low with the press running. This signal CST-0 is applied to the preset inputs of the memory flip-flops 162 and 164 and sets the output signals YLA-1 and RLA-1 high. The signal CST-0 is also applied to the preset inputs of flip-flops 508 and 510 and sets $\overline{Q}$ output signal SCL-0-of logical low and sets the Q output signal BLT-1 of the flip-flop 510 at logical high. The measurement circuit produces output signals YCP-1 and RCP-1 which are both high and applied to the respective data inputs of the memory flip-flops 162 and 164. The measurement circuit also produces an output signal RAT-0 which is high during clutching (before ramping begins) and this signal is applied to one input of an OR gate 512. The other input of the OR gate 512 receives the Q output of the flip-flop 510. The OR gate 512 produces an output signal TST-1 which is high and which is applied to one input of an exclusive OR gate 514. The other input of the exclusive OR gate 514 receives the signal SCL-O from the flip-flop 508 which as stated previously is low. The exclusive OR gate 514 produces an output signal ACT-1. The signal ACT-1 is applied to the relay driver circuit which will be described presently. The signal ACT-1 is also applied to the clock input of a flip-flop 516. This flip-flop receives the signal BRK-1, which as previously noted is high on the clear input of the flip-flop. This flip-flop produces a $\overline{Q}$ output signal TSS-1 which is high and which is applied to one input of an exclusive OR gate 518. The other input of the exclusive OR gate 518 receives the brake signal BRK-1 which, as previously noted, is low. Accordingly, the exclusive OR gate 518 produces an output signal ACT-2 which is high. This signal ACT-2 is applied to the relay driver circuit in a manner to be described below. A one-shot 520 receives the brake signal BRK-1 at its trigger input and produces a $\overline{Q}$ output signal TSC-0. With the BRK-1 signal at a logical low the output signal TSC-O is at logical high. This $\overline{Q}$ output is connected through a diode 522 to the upper input of the OR gate 512 for pulling that input low during the time-out of the one-shot 520 after the signal BRK-1 goes high. The $\overline{Q}$ output of the flip-flop 520 is also applied to the clear input of the flip-flop 508.

In the state of the logic circuit 500 just described, which obtains with the press running and before the brake is initiated, the output signals ACT-1 and ACT-2 are both high. These signals are applied to the relay driver circuit 502 of FIG. 16*b*. Also, additional logic signals are supplied to the driver circuit 502, as follows: The self-check circuit 400 produces an output signal ALM-1 which is high with the press running if the necessary static self-check conditions obtain. The counter circuit 410 produces an output signal REP-1 which is high with the press running if the total number of pulses since clutch engagement is less than 384 and the latch circuit 208 produces an output signal LAT-1 which is normally high with the press running. Additionally, an OR gate 524 receives, at one input, the signal RLA-1 from the memory flip-flop 164. This signal RLA-1 is high when the press is running. The OR gate 524 receives, at its other input, from the counter 410 the signal TSQ-0 which is high when the crank is in the safety stop region and low in the top-stop region. Accordingly, the output signal TSR-1 of the OR gate 524 is high with the press running.

The output signal TSR-1 of the OR gate 524 is applied to one input of a NOR gate 526, shown in FIG. 16*a*. The NOR gate 526 receives the signal REL-0 from the self-check reset circuit 380. Another input of the NOR gate 526 receives the signal ACT-1 from the exclusive OR gate 514. All of the input signals to the NOR gate 526, with the press running, are high and the output signal of the NOR gate is low. This output signal is applied to the toggle input of the one-shot 504.

RELAY DRIVER CIRCUIT OF FIG. 16*b*

The relay driver circuit 502 of FIG. 16*b* is similar to the relay driver circuit shown in FIG. 6*b* but additional AND gates are provided. The relay driver circuit 502 comprises AND gates 530, 532, 534, 536, 538 and 540. The signal ALM-1 from the self-check circuit 400 is applied to one input of the AND gate 530 and one input of the AND gate 538. The output signal ACT-1 from the measurement circuit 500 is applied to one input of the AND gate 534 and one input of the AND gate 536. The output signal ACT-2 from the measurement circuit is applied to one input of the AND gate 532 and one input of the AND gate 540. The output signal LAT-1 from the latch circuit 208 is applied to one input of the AND gate 530 and one input of the AND gate 540. The output REP-1 of the counter 410 is applied to one input of the AND gate 534 and to one input of the AND gate 536. Finally, the output TSR-1 of the OR gate 524 is applied to one input of the AND gate 532 and to one input of the AND gate 538.

The AND gates 530, 532, and 534 each have open-collector outputs connected to the base of the driver transistor 180 and through a resistor to the positive terminal of a logic voltage source $V_{cc}$. Similarly, the AND gates 536, 538 and 540 each have open-collector outputs connected to the base of the driver transistor 182 and through a resistor to the positive terminal of a logic voltage source $V_{cc}$. As described above, the driver transistor 180 includes the relay winding 166 and a voltage source in its output circuit. Similarly, the driver transistor 182 includes the relay winding 174 and a voltage source in its output circuit. When all inputs to all of the AND gates 530, 532 and 534 are high the outputs will be high and the driver transistor 180 will be turned on and the relay coil 166 will be energized. However, if any one or more of the inputs to these AND gates is low the driver transistor 180 will be turned off and the relay will be dropped out. Similarly, with all of the inputs to the AND gates 536, 538 and 540 at a logical high the outputs of the AND gates will be high and the driver transistor 182 will be turned on and the relay winding 174 will be energized. If any one or more of the inputs to the AND gates is low the transistor 182 will be turned off and the relay will be dropped out. In the state of the circuits with the press running, as is described above, all of the inputs to all of the AND gates of the relay driver circuit are high and the driver transistors are turned on. In this condition, the display circuit 112 will turn on the green lamp.

With the press running in the single stroke mode in normal operation a top-stop signal will be produced and brake application will be initiated when the crank is about 270° to 30° before top center. In the event of a safety stop, as may be initiated by an intrusion into the pinch point of the press or by some other warning signal, brake application may be initiated at any point in the cycle.

SELF-CHECKING DURING BRAKING

Operation of the circuit of FIGS. 16*a* and 16*b* during braking will now be described with reference to the timing diagram of FIG. 17.

With the press operating in the single stroke mode, upon the initiation of braking (by deenergizing the solenoid 30 as shown in FIG. 2), the clutch-brake signal circuit 100 causes the signal BRK-1 to go high, as indicated at point 1B, FIG. 17. As a result, the reset circuit 300 changes the output signal CST-O from low to high, as shown at point 2B. The signal BRK-1 is applied to the motion stopped detector 110 and the output signal BRT-O goes from high to low. The clutch-brake signal BRK-1 is also applied to the measurement circuit 600 and, as described above with reference to FIG. 6*a*, the timing circuit initiates the ramp voltage. The clutch-brake signal BRK-1 in going from low to high also removes the clear from the one-shot 504.

In the self-check during braking, the clutch-brake signal BRK-1 is used to initiate the drop out of the relays by shutting off driver transistors 180 and 182 through two independent signal paths including the signals ACT-2 amd ACT-1. If the self-check shows a malfunction, the relays will be allowed to drop out and the machine will be shut down. On the other hand if the self-check shows no malfunction the relays will be reenergized before they are latched out by the latch 208. The self-check will indicate no malfunction if both driver transistors 180 and 182 are turned off and then turned back on again within the preset delay time of the latch 208. As will be understood from the following description, the self-check will be test the operativeness of the measurement circuit (signal RAT-O) the one-shot 520 (signal TSC-O) the flip-flop 508 (SCL-O), one-shot 510 (signal BLT-1), OR gate 512 (TST-1) exclusive OR gates 514 and 518 (signals ACT-1 and ACT-2) and flip-flop 516 (signal TSS-1). The self-check cycle will be described below.

When the clutch brake signal BRK-1 goes high the output signal ACT-2 of the exclusive OR gate 518 goes low at point 3B in FIG. 17. This causes both driver transistors 180 and 182 to be turned off. When the clutch-brake signal BRK-1 goes high it triggers the one-shot 520 and the $\overline{Q}$ output signal TSC-O goes low, as shown at point 4B, and will remain low for the time-out period of 9 milliseconds. When the signal ACT-2 goes low at the output of the exclusive OR gate 518 it sets the clear of the flip-flop 510 and the Q output BLT-1 goes from high to low at point 5B. However, the state of the OR gate 512 remains unchanged because the other input signal RAT-O remains high for a short time delay interval only, as will be described below. Accordingly, the output signal TST-1 remains high during this time delay interval. The signal BRK-1 is its high state causes the output signal TSC-O of the one-shot 520 to go low and that clears the flip-flop 508, causing the output signal SCL-0 to go from low to high at point 6B. Consequently, both inputs to the exclusive OR gate 514 are high and its output signal ACT-1 goes low at point 7B. This signal ACT-1 is applied to the AND gates 534 and 536 in the relay drive circuit and causes their outputs to go low. Accordingly, signal ACT-1 in going low operates to turn off the driver transistors 180 and 182. As mentioned above, the transistors were previously turned off independently of ACT-1 by the signal ACT-2. With both of the driver transistors 180 and 182 turned off, the self-check reset circuit 380 causes the output signal REL-O to go low at point 8B.

In the operation of the self-check during braking as thus far described, the driver transistors 180 and 182 have been turned off by two signal paths, namely, the signal paths of ACT-1 and ACT-2. If either of these signals remain low for more than the latch delay time, the latch 208 will take over and shut down the machine. The signal RAT-O is adapted to turn the driver transistors back on within 5 milliseconds after the signals ACT-1 and ACT-2 go low. A time-delay interval in the change of signal RAT-O from low to high was mentioned above and will be now described. The signal RAT-O from the measurement circuit 600 is developed across a capacitor 252 and the collector of transistor 244, as described with reference to FIG. 6*a*. When the ramp is initiated by the clutch-brake signal BRK-1 going high, the transistor 244 is turned on to discharge the capacitor and change the signal RAT-O from high to low. At the same time, the clutch-brake signal BRK-1 triggers the one-shot 520 and, as stated above, the $\overline{Q}$ output signal TSC-O goes low for a period of 9milliseconds. This $\overline{Q}$ output is connected through the diode 522 to the upper input of the OR gate 512. As a result of the capacitor and diode combination, the signal RAT-O takes a significant time, TD, say about 1 millisecond but less than 5 milliseconds, to change from high to low at point 9B. Consequently the output signal TST-1 of the OR gate 512 undergoes a change from its high state to its low state at point 10B. This causes the exclusive OR gate output signal ACT-1 to undergo a change of state from low to high at point 11B. Thus, ACT-1 is restored to a high state before the latch 208 operates.

When ACT-1 goes from low to high, the flip-flop 516 is triggered and the output signal TSS-1 goes from high to low at point 12B. Accordingly, the output signal ACT-2 of the exclusive OR gate 518 goes from low to high at point 13B. When ACT-2 goes high both driver transistors 180 and 182 are turned back on the signal REL-0 from the self-check reset circuit 380 goes from low to high at point 14B. In this self-check cycle both ACT-1 and ACT-2 have been taken low and back high again before the latch time of latch 208. The signal ACT-1, in going low and then high again, causes the signal ACT-2 to be restored from low to high. If the signal TSS-1 had stuck high, the signal ACT-2 would not have come back up to logical high and the machine would have been shut down. If ACT-2 is not switched from high to low then the signal BLT-1 remains high and TST-1 will not go from high to low and this will cause ACT-1 to go low and stay low until latch out.

OTHER SELF-CHECKS DURING BRAKING

As noted above, the one-shot 520 produces an output signal TSC-O which goes low when the clutch-brake signal BRK-1 goes high. The signal TSC-O times out in 40 milliseconds and goes back high again. This 9 millisecond time-out is used for performing certain checks. One of these checks is to determine whether the motion stop signal BRT-1 goes high as it should, after the clutch-brake signal BRK-1 goes high. If BRT-1 does not go high when BRK-1 goes high, or, if BRT-1 goes low before TSC-0 times-out and goes high, then the relays are latched out.

Also, a check is made to see whether the ramp signal RAT-0 goes high after the signal TSC-0 has timed-out and gone high. If the ramp voltage stops because of a circuit failure or any other reason, the signal RAT-0 goes high. If this happens, the upper input of OR gate 512 goes from low to high. This will cause shut down of the machine.

An additional check during brakingis to determine whether the encoder is producing pulses. It will be recalled that one check for the existence of encoder pulses is performed in the counter circuit 410 which was described with reference to FIG. 15. In this check, the encoder pulse signal TRA-1 is applied to the one-shot 426 which produces a 100 millisecond or stretched encoder pulse ECL-1 which, in turn, is applied to the self-check circuit 400 of FIG. 14. If the signal ECL-1 is low it indicates the absence of encoder pulses. The signal BKD-1 will go low 100 milliseconds after clutching and the clutch-brake signal BRK-1 will be low and the self-check circuit 400 will cause the machine to be shut down.

There is also a check for encoder pulses at the output of the encoder signal circuit 108 through the exclusive OR gate 264 and the inverter 274, as shown in FIG. 7. The output signal ENC-1 from the encoder signal circuit is applied through the input of the motion stop detector 110 to the one-shot 320, as shown in FIG. 10. In the absence of the encoder pulses, the signal BRT-1 in the detector will go low 5 milliseconds after the clutch-brake signal BRK-1 goes high. At this time the motion stop detector output signal BRT-0 goes from low to high and this signal is applied to the AND gate 506 in the logic circuit of FIG. 16*a*. The signal TRI-1 out of the AND gate 506 triggers the memory flip-flops 162 and 164 to sample the output signals YCP-1 and RCP-1 of the comparators 142 and 144 in the measurement circuit 600. At this time, however, the signal TSC-0 from the $\overline{Q}$ output of one-shot 520 is low. This signal TSC-0 is applied to the clear input of the flip-flop 508 which forces the $\overline{Q}$ output SCL-0 to go high. This output of the flip-flop 508 is applied to the base of a switching transistor 602 and the signal SCL-0 in the high state turns on the transistor. When the transistor 602 is turned on its grounds the reference voltage source for the comparators 142 and 144. Since the ramp voltage will now be higher than the reference voltages at the comparators both YCP-1 and RCP-1 will be low. Thus, in the absence of encoder pulses signified by the signal ENC-1, the strobing of the memory flip-flops 162 and 164 by the signal TRI-1 will cause the outputs YLA-1 and RLA-1 to go low. When RLA-1 goes low the output signal TSR-1 of OR gate 524 (in FIG. 16*b*) goes low and the relays are dropped out for more than 5 milliseconds and are latched by the latch 208.

SELF-CHECKING AT STOPPING OF THE PRESS

The operation of the circuit of FIGS. 16*a* and 16*b* at the stopping of the press will now be described with reference to the timing diagram of FIG. 18.

With the press operating in the single stroke mode, a self-check is performed each time the press comes to a stop. When the press motion stops, the output signal BRT-0 of the motion stop detector 110 goes from low to high. The signal BRT-0 going from low to high initiates the second self-check.

In the self-check at motion-stop time, the motion stop signal BRT-0 is used to initiate the dropout of the relays by shutting off the transistors 180 and 182 through independent signal paths including the signals ACT-1 and TSR-1. If the self-check shows a malfunction, the relays will be allowed to drop out and the machine will be shut down; if not, the relays will be re-energized before they are latched out by the latch 208. The self-check cycle at motion-stop time will be described below.

Refer now to the timing diagram of FIG. 18. Note that the signal TSQ-0 from the AND gate 424 is continuously low (as shown in solid line) indicating that a top-stop is being executed. When the press comes to a stop, the signal BRT-1 in the motiom stop detector 110 makes a transition from high to low, as shown at point 1S in FIG. 18, and the complementary output signal BRT-0 goes from low to high. The signal BRT-0 is applied to the AND gate 506 and the output signal TRI-1 thereof goes from low to high and clocks or strobes the memory flip-flops 162 and 164. At this time, the signal SCL-0 at the $\overline{Q}$ output of the flip-flop 508 is still high and consequently the transistor 602 is turned on. This grounds the reference inputs of the comparators in the measurement circuit 600 and consequently the output signals YCP-1 and RCP-1 are both low. Thus, at the strobing of the memory flip-flops 508 and 510 the output signals thereof RLA-1 and YLA-1 both go low, as indicated at points 2S and 3S in the timing diagram. This causes the output of the NOR gate 507 to go high which clocks the flip-flop 508 and forces the output signal SCL-0 to go low, as shown at point 4S on the timing diagram of FIG. 18. This changes the state of the exclusive OR gate 514 and the output signal ACT-1 goes low, as shown at point 5S on the timing diagram of FIG. 18. This turns off the transistors 180 and 182 and the relays start to drop out. Since the output signal RLA-1 from the memory flip-flop 164 was forced low at the strobing by TRI-1, the output signal TSR-1 of the NOR gate 524 goes low, as shown at point 6S, since a top-stop is indicated by the signal TSQ-0 being low. The driver transistors 180 and 182 will be turned off by reason of signal TSR-1 going low. With both transistors 180 and 182 turned off, the signal REL-0 from the self-check reset circuit 380 goes low, as shown at point 7S in the timing diagram of FIG. 18.

When the relay dropout signal REL-0 goes low at the input of th NOR gate 526, along with signals TSR-1 and RLA-1 being low, the output of the NOR gate goes high. This triggers the one-shot 504 and causes the output signal STR-0 to go from high to low as indicated at point 8S in FIG. 18. This causes the output of the AND gate 506 to go low but that does not change the state of the memory flip-flops 162 and 164 at this time. The one-shot 504 times out in 300 microseconds and when it goes from low to high, as shown at point 9S in FIG. 18, it causes signal TRI-1 of the AND gate 506 to go high and strobes the memory flip-flops 162 and 164. By this time, the signal SCL-0 from the flip-flop 508 has gone from high to low, as shown at point 4S in FIG. 18. Consequently, the switching transistor 602 is turned off and the comparators in the measurement circuit 600 take up their respective reference voltages of *v*1 and *v*2. Assuming, for explanatory purposes, that the ramp voltage in the measurement circuit is at a value between reference voltages *v*1 and *v*2, the output signal YLA-1 from the memory flip-flop 162 will be low and the output signal RLA-1 from the memory flip-flop 164 will be high, as shown at point 10S in FIG. 18. (It will be recalled that this combination of RLA-1 and YLA-1 from the measurement circuit causes the yellow lamp to be lighted for a top-stop, thus warning that the brake is safe but approaching a hazardous condition.) With the signal RLA-1 in the high state, the signal TSR-1 goes from low to high, as shown at point 11S in FIG. 18. When the output signal STR-0 of the flip-flop 504 went high at point 9S, the flip-flop 510 is triggered thereby and the output signal BLT-1 goes from low to high, as indicated at point 12S in FIG. 18. This causes the output signal TST-1 from the NOR gate 512 to go from low to high (the other input being the ramp signal RAT-0 which is still low). Thus, the signal TST-1 goes high as indicated at point 13S in FIG. 18. This causes the exclusive OR gate 514 to change state and the output signal thereof ACT-1 goes high, as shown at point 14S in FIG. 18. When ACT-1 goes high, the driver transistors 180 and 182 are turned back on (TSR-1 has already gone high), and consequently the signal REL-0 goes high, as shown at point 15S in FIG. 18. Thus, the relays have been de-energized and then re-energized before they could drop out and the self-check cycle has been completed without signifying any malfunction.

If the top-stop operation described immediately above had taken a longer time, greater than *t*2, the signal RLA-1 would be low on the second strobing of the memory flip-flops 508 and 510. This would cause the press to be shut down in the normal function of the monitor. With RLA-1 remaining low at the second strobe STR-0 instead of going high at point 10S, the signal TSR-1 would stay low. The latch 208 would consequently have reenforced the shut-down and maintained it even if another clutch signal occurs. With TSR-1 at the output of the OR gate 524 being low, the light emitting diode 525 would be turned on indicating a deceleration failure.

If a safety stop is executed instead of a top-stop, as assumed in the self-check cycle described immediately above, the press would not have been shut down by reason of a stopping time greater than *t*2 but less than *t*3. In the case of a safety stop, the signal TSQ-0 from the counter 410 will go low at a motion-stop time, i.e. when BRT-1 goes low as indicated by point 1S is FIG. 18; however, TSQ-0 stays low only 30 microseconds as indicated in the dashed lines for signal TSQ-0 in FIG. 18. This low state of TSQ-0 is produced by the time-out period of one-shot 458. Consequently, the output signal TSR-1 from the OR gate 524 goes high at the end of the 30 microsecond time delay even though the signal RLA-1 is low, as indicated by the dashed line for signal TSR-1 in FIG. 18. Since TSR-1 remains high, an ACT-1 will be restored from low to high after the self-check. Thus the machine will not be latched off in a safety stop even though RLA-1 has gone low signifying that the stopping time has exceeded *t*2.

SELF-CHECKING DURING CLUTCHING

The operation of the circuit of FIGS. 15, 16*a* and 16*b* at the time of clutch initiation will be described with reference to the timing diagram of FIG. 19.

The clutch-brake signal BRK-1 goes low at the initiation of clutching, as shown at point 1C in FIG. 19. This causes the brake delay signal BKD-1 from the self-check circuit 400 to go high at point 2C and remain high for 100 milliseconds. During this delay period the press will start moving and transducer pulse signal TRA-1 is generated as indicated. The transducer signal TRA-1 is applied to the one-shot 426 and the trailing edge of TRA-1, at point 3C in FIG. 19 causes the stretched transducer signal ECL-1 to go high at point 4C. Signal ECL-1 remains high for 100 milliseconds after the transducer pulse. The signal ECL-1 is applied to the one-shot 430 and causes the signal CLR-1 to go high and then go low after five milliseconds drop-out time as shown at points 5C and 6C in FIG. 19. When CLR goes high, its complement CLR-0 goes low and this sets the counter 420 with its output MSD-1 at logical high, as shown at point 7C. At the same time, counter 418 is set with its output SSD-1 at logical low, as shown at point 8C.

A self-check is performed on the counters 414, 416, 418 and 420 at the start of clutching and in connection with the resetting of the counters. The purpose of the self-check is to make sure that the counters are operative and this is done by incrementing the counters and determining whether the driver transistors of the relays are turned off and back on again before the relays are latched out. This turning off of the driver transistors is accomplished by a signal which is initiated by the signal CLR-1 and propagated through the counters and thence through two independent paths to the drive transistors.

The first independent path from the counters involves the signal REP-1 from the OR gate 436. It will be recalled that counter 418 was reset with its Q output low and counter 420 was reset with its $\overline{Q}$ output high by the signals CLR-1 and CLR-0 which occur at the trailing edge of the first transducer pulse, i.e. when ECL-1 goes high. When the trailing edge of the second encoder pulse occurs, at point 9C, the counter 414 is decremented and all stages thereof go from low to high and similarly all stages of the counter 416 go from low to high. The high output of the counter 416 triggers the counter 418 so that its Q output signal SSD-1 goes from low to high, at point 10C in FIG. 19. Counter 418 triggers counter 420 so that its $\overline{Q}$ output, namely signal MSD-0, goes from high to low at point 11C. At this point in time both inputs to the OR gate 436 are low and the output signal REP-1 goes low at point 12C. As noted above, the signal REP-1 is applied to the relay circuit and when it is low, the driver transistors will be turned off. If REP-1 stays low long enough the relays will drop out and shut the machine off. If it desired therefore to turn the driver transistors back on, after having demonstrated that all stages of the counters are operative. For this purpose, the relay check signal REL-0 from the self-check reset circuit 380 is used in conjunction with other logic signals to restore the counters 418 and 420. When REP-1 goes low it turns off the driver transistors and this causes REL-0 to go low at point 13C. A NOR gate 442 has one input connected with the output of the OR gate 436 to receive the signal REP-1. Another input of the NOR gate 442 is connected with the self-check reset circuit and receives the signal REL-0. A third input to the NOR gate 442 is connected with the output of a NOR gate 444 which has one input connected with the output of the one-shot 402 in the self-check circuit 400 and hence receives the signal BKD-1. The other input of the NOR gate 444 is connected with an inch-continuous signal source which produces a signal SNG-1 which is always low when operated in single stroke mode. (SNG-1 is high when operated in the continuous mode and therefore the counter self-check function is performed also in a continous mode.) In single stroke mode, with SNG-1 at a logical low, the output signal ABC-1 of the NOR gate 444 will be low only when the signal BKD-1 is high. BKD-1, as described above, goes high and remains high for 100 milliseconds after initiation of clutching. Now consider the state of the inputs to the NOR gate 442; the signal ABC-1 will be low immediately after initiation of clutching, the signal REP-1 will be low because the signal SSD-0 from counter 418 is low and the signal MSD-0 from counter 420 is low. When REP-1 goes low it causes the relay check signal REL-0 to go low, signifying that the driver transistors are turned off to initiate drop-out of the relays. With all of the inputs to the NOR gate 442 at a logical low, the output signal RAR-1 goes high at point 14C in FIG. 19. The signals RAR-1 is applied through an inverter 446 to the sets input of the counter 420. This produces a high to low transition at the set input of the counter 420 which sets the $\overline{Q}$ output signal MSD-0 high at point 15C. The output RAR-1 of the NOR gate 442 is also connected to one input of the NOR gate 440, as noted above. The other input of the NOR gate 440 is connected with the Q output signal CLR-1 of the one-shot 430. This clears signal CLR-1 has made a transition from high to low by the time the signal RAR-1 is applied to the NOR gate 440. Accordingly, when the signal RAR-1 goes high the output signal RSR-0 of the NOR gate 440 goes low and resets the counter 418 at its Q output to a logical low at point 16C. Thus, a self-check of the counters, without occurrence of a malfunction, causes the counters 418 and 420 to be restored so that the output signals SSD-1 and MSD-0 are respectively at logical low and logical high. Consequently, the signal SSD-0 from counter 418 is high and the signal MSD-0 from counter 420 is high at the respective inputs of the OR gate 436. This causes the output REP-1 of the OR gate 426 to go high at point 17C and switch the driver transistors back on.

There is a possibility that the signal MSD-0 from counter 420 at its Q output never goes low but that the counter 418 would be cleared. In that case the $\overline{Q}$ output signal SSD-0 of counter 418 would be restored to a logical high and that input to the OR gate 436 would cause the output signal REP-1 to go high and turn the driver transistor back on. With such a malfunction of counter 420, the $\overline{Q}$ output signal MSD-0 would remain low at the other input of the OR gate 436. When the transducer has produced the first 128 pulses, the $\overline{Q}$ output signal SSD-0 of the counter 418 will go low causing both inputs to the OR gate 436 to be low. This will cause the output signal REP-1 to go low, and as a result of the malfunction of the counter 420, the signal REP-1 will shut the machine down.

SELF-CHECKING OF THE COUNTERS IN THE CONTINUOUS MODE

As mentioned above, the anti-repeat circuitry is self-checked by causing a fault to be induced through the counters and if the proper response is evoked, the reset of the counters is allowed. Resetting of the counters requires that the output signal RAR-1 from the NOR gate 442 undergo a transition from low to high. This self-checking of the counters is performed on each press cycle, even when the press is operated in the continuous mode. The NOR gate 444 in the circuit 410 of FIG. 15 receives a signal SNG-1 from the inch-continuous control 450. This signal SNG-1 is at a logical low when the press is operated in single stroke mode and is at a logical high when it is operated in the continuous mode. When the press is operated in the continuous mode the signal BKD-1 is low at all times during clutching except during the first 100 milliseconds after initiation of clutching. Consequently, the NOR gate 444, in the continuous mode operation, allows an unconditional reset in the following manner. The signal ABC-1 from the NOR gate 444 is continuously low. Whenever REP-1 goes low, which occurs when both SSD-0 of counter 418 and MSD-0 of counter 420 are low, the driver transistors are shut off. When the driver transistors shut off the signal REL-0 goes low, making all inputs to the NOR gate 442 low. This causes the output signal RAR-1 to go high and reset the counters 418 and 422; in turn, this causes REP-1 to go high and turn on the driver transistors before the relays can drop out.

ALTERNATE PATH FOR SELF-CHECKING THE COUNTERS

As discussed above, the self-checking function, for the sake of reliability, is performed through two independent circuit paths, or, in some cases, through a path that has already been checked. For self-checking the counters, the path utilizing the signal REP-1 was described above. In case that path includes a malfunction, such as OR gate 436 being stuck high so that REP-1 will not go low, it is desirable to provide another path to see if the counters are operative to produce a signal which will shut down the press. This alternate path includes the path of signal ARC-0 which was mentioned above in connection with the self-check circuit 400 and the NOr gate 406. The circuit of FIG. 15 comprises a set of three NOR gate 452, 454 and 456 for producing the signal ARC-0. The clear signal CLR-1 from the Q output of the one shot 430 is applied to one input of the NOR gate 452. The clear signal is a pulse which is generated by the first transducer pulse following the initiation of clutching. The clear signal CLR-1, it will be recalled, along with its complement CLR-0 and the receipt of the second encoder pulse sets the signal REP-1 low, assuming that the counters and the OR gate 436 function properly. Referring again to NOR gates 452 and 454, it will be noted that the signal RAR-1 from the NOR gate 442 is applied to one input of the NOR gate 454. RAR-1 will be low at this time and the output signal ARS-0 will be high. The signal ARS-0 is applied to the other input of the NOR gate 452 and accordingly its output signal ARS-1 will be low. The output signal ARS-1 is applied to one input of the NOR gate 456. The signal BKD-1 is applied to the other input of the NOR gate 456. Signal BKD-1 goes high at the initiation of clutching and times out to a low after 100 milliseconds. Accordingly, the NOR gate 456 produces an output signal ARC-0 which goes high at 100 milliseconds following clutch time. The signal ACR-0 from the NOR gate 456 is applied to the self-check circuit 400 at one input of the NOR gate 406. When ARC-0 goes high the signal MON-1 goes low. The signal MON-1 is applied to one input of the AND gate 408 and when it goes low the output signal ALM-1 goes low and turns off the driver transistors. This will shut down the machine unless RAR-1 from NOR gate 442 goes high within 5 milliseconds to cause ARS-0 from gate 454 to go low. If RAR-1 does go high and ARS-0 goes low then ARS-1 from gate 452 will go high causing the signal ARC-0 from gate 456 to go low. Then when ARC-0 goes low the signal MON-1 will go high and the shut down signal ALM-1 will go low and turn on the driver transistors. This turning back on the transistors occurs only if the signals REP-1, RAR-1 and ARC-0 are all good.

The embodiments of the present invention in which an exclusive property or privilege is claimed are defined as follows:

1. A brake monitor for a press having clutch means, brake means and control means for alternately starting and stopping the press crank in a cycle of operation, said monitor comprising: a signal circuit adapted to be connected with the press to produce a brake signal at the start of braking, a timing circuit responsive to the brake signal for generating a timing signal having a value which is a function of time, said signal circuit being connected with the timing circuit for starting the timing signal, detecting means connected with the timing circuit for producing logic signals indicative of the value of the timing signal relative to reference signals representing stopping times for the press, motion stop detecting means adapted to be connected with the press for generating a motion stop signal when the press comes to a stop, memory means connected with the detecting means for storing said logic signals in response to a motion stop signal, a relay circuit adapted to be connected with said control means of the press for shutting down the press in response to a disabling signal, and logic means connected to said memory means and producing a disabling signal when said logic signals represent a timing signal indicative of excessive stopping time, said logic means being connected with the relay circuit to apply the disabling signal thereto for shutting down the press when the stopping time is excessive.

2. The invention as defined in claim 1 including reference means connected with said detecting means and applying first and second reference signals thereto which represent first and second stopping times, respectively, for the press, said second reference signal being greater than said first reference signal and said second stopping time being greater than said first stopping time, said logic means producing a disabling signal when said logic signal represents a timing signal which exceeds said second reference signal.

3. The invention as defined in claim 2 including transducer means for generating a position signal indicative of the angular position of the press crank for classifying each stop of the press as a top-stop if the position of the crank is in a first angular range and as a safety stop if the position of the crank is in a second angular range, said transducer means being connected with said logic means to shut down the press when said position signal is in said second angular range and the logic signal represents a timing signal greater than the second reference signal.

4. The invention as defined in claim 3 including display means having a first, second and third condition indicating element and selection means connected with the memory means and responsive to said logic signals for energizing the first indicating element when the timing signal is less than the first reference signal and for energizing the second indicating element when the timing signal is greater than the first reference signal but less than the second reference signal, said selection means also being connected with said relay circuit for energizing the third indicating element when the press is shut down.

5. The invention as defined in claim 4 including additional reference signal means for producing a stop limit signal when the timing signal exceeds a third reference signal which is higher than the second reference signal, said additional reference signal means being connected with said logic means for producing a disabling signal when said timing signal exceeds said third reference signal.

6. The invention as defined in claim 5 wherein said relay circuit includes a relay adapted to be connected with said control means for the press, a driver transistor connected with relay for energizing the relay, and a logic gate having an output connected with the driver transistor and having at least one input connected with said logic means.

7. The invention as defined in claim 6 including a latch having an input connected with said driver transistor and an output connected with another logic gate for shutting down said press only if the disabling signal has a time duration greater than a predetermined value.

8. The invention as defined in claim 7 wherein said transducer means comprises an encoder adapted to be connected with said press crank for producing a train of pulses with each pulse corresponding to equal angular increments of displacement and counting means connected with the encoder for counting said pulses.

9. The invention as defined in claim 8 wherein said motion stop detector is connected with said transducer means and includes means for producing a motion stop signal in response to spacing of said pulses greater than a predetermined time.

10. The invention as defined in claim 9 wherein said timing circuit comprises an integrater for producing a substantially linear ramp voltage, and means for adjusting the slope of said ramp voltage for calibration of said timing circuit with reference to the operating characteristics of the press.

11. The invention as defined in claim 10 wherein said additional reference voltage means comprises a voltage limiting means connected with said integrater for limiting said ramp voltage to said third reference voltage, and means connected with voltage limiting means for differentiating said ramp voltage.

12. The invention as defined in claim 10 wherein said memory means comprises a pair of flip-flops each having data and clock inputs and an output, said voltage level detecting means comprising first and second comparators, one of said flip-flops having its data input connected with the output of the first comparator and the other of said flip-flops having its data input connected with the second comparator, the clock input of said flip-flops being connected with said motion stop detector and responsive to the motion stop signal for memorizing said logic signals on said outputs of the flip-flops.

13. The invention as defined in claim 8 including an overrun anti-repeat detecting means including counting means connected with said transducer means and producing an overrun stop signal when a predetermined angular displacement is indicated, said anti-repeat detecting means being connected with said logic means for producing a disabling signal in response to said overrun stop signal.

14. A brake monitor for a press having clutch means, brake means and control means for alternately starting and stopping the press crank in a cycle of operation, said monitor comprising; condition signalling means including a brake signal circuit adapted to be connected with the press to produce a brake signal at the start of braking and motion stop detecting means adapted to be connected with the press for generating a motion stop signal when the press comes to a stop, timing means connected with the brake signal circuit and with the motion stop detecting means and being responsive to said brake signal and to said motion stop signal for measuring the elapsed time therebetween, relay means adapted to be connected with the control means of the press for shutting down the press when the relay means are actuated from one condition to another, said relay means including control signal responsive means for receiving plural control signals, each of the control signals being changeable from an enabling state to a disabling state and vice versa, actuation of the relay means being initiated by any one of said control signals being in the disabling state, logic means connected to the timing means and to the control signal responsive means and producing a first control signal, said first control signal being in a disabling state when the elapsed time exceeds a predetermined value and being in an enabling state when the elapsed time is less than said predetermined value, said logic means including disabling means connected with the condition signalling means for forcing the first control signal to change to the disabling state, restoring means connected with the disabling means for forcing the first control signal to change back to the enabling state within a time delay which is less than the time required for actuation of the relay means, said logic means including checking means responsive to said first control signal for producing a second control signal in a disabling state unless the first control signal changes to the disabling state and back to the enabling state within said time delay in response to the condition signalling means.

15. The invention as defined in claim 14 wherein said logic means includes means responsive to said first control signal and connected with said restoring means for disabling the restoring means unless said first control signal changes from the enabling state to the disabling state.

16. The invention as defined in claim 14 wherein said logic means includes third control signal means for producing a third control signal and being connected with said control signal responsive means, said disabling means being connected with the third control signal producing means for forcing the third control signal to change to the disabling state, said restoring means being connected with the third control signal producing means for forcing the third control signal to change back to the enabling state within a time delay which is less than the time required for actuation of the relay means, said checking means being responsive to said third control signal for producing said second control signal in a disabling state unless the third control signal changes to the disabling state and back to the enabling state within the said time delay in response to the condition signalling means.

17. A brake monitor for a press having clutch means, brake means and control means for alternately starting and stopping the press crank in a cycle of operation, said monitor comprising: condition signalling means including a clutch-brake signal circuit adapted to be connected with the press to produce a brake signal at the start of braking and to produce a clutch signal at the start of clutching and motion stop detecting means adapted to be connected with the press for generating a motion stop signal when the press comes to a stop, timing means connected with the clutch-brake signal circuit and the motion stop detecting means and being responsive to said brake signal and to said motion stop signal for measuring the elapsed time therebetween, relay means adapted to be connected with the control means of the press for shutting down the press when the relay means are actuated from one condition to another, said relay means including control signal responsive means for receiving plural control signals, each of the control signals being changeable from an enabling state to a disabling state and vice versa, actuation of the relay means being initiated by any one of said control signals being in the disabling state, logic means connected to the timing means and to the control signal responsive means and producing a first control signal, said first control signal being in a disabling state when the elapsed time exceeds a predetermined value and being in an enabling state when the elapsed time is less than said predetermined value, self-checking means including a disabling signal circuit in said logic means connected with the conditon signalling means and forcing the first control signal to said disabling state in response to at least a selected one of the signals produced by the condition signalling means to initiate actuation of the relay means, a time delay latch connected with said relay means and responsive to initiation of actuation of the relay means for producing, after a first predetermined time delay, a second control signal latched in a disabling state, a restoring circuit in said logic means and producing a restoring signal following said selected one of the signals by a second predetermined time delay, said restoring circuit being connected with said disabling signal circuit and forcing the first control signal to change to said enabling state, said second predetermined time delay being shorter than said first predetermined time delay and being less than the time required for actuation of the relay means, whereby said time delay latch will not produce the second control signal if the disabling signal circuit is operative and the first control signal changes to said enabling state within said second predetermined time delay.

18. The invention as defined in claim 17 wherein said at least a selected one of the signals includes said brake signal.

19. The invention as defined in claim 17 wherein said at least a selected one of the signals includes said motion stop signal.

20. The invention as defined in claim 17 wherein said at least a selected one of the signals includes said clutch signal.

21. The invention as defined in claim 17 wherein said at least a selected one of the signals includes said brake signal, said motion stop signal and said clutch signal.

22. The invention as defined in claim 1 wherein said signal circuit is adapted to produce a brake signal in response to a brake control signal and to produce a clutch signal in response to a clutch control signal, and a differential time constant circuit connected between said control means and said signal circuit to provide a clutch signal delay greater than the brake signal delay.

* * * * *

UNITED STATES PATENT OFFICE

CERTIFICATE OF CORRECTION

Patent No. 4,048,886 Dated September 20, 1977

Inventor(s) John Francis Zettler

It is certified that error appears in the above-identified patent and that said Letters Patent are hereby corrected as shown below:

Col. 7, line 5 after "feedback" insert --network--.
Col. 7, line 28 "operatonal" should be --operational--.
Col. 10, line 56 "276" should be --176--.
Col. 11, line 10 before "If" insert --(--.
Col. 11, line 49 "According" should be --Accordingly--.
Col. 13, line 25 "Encloder" should be --Encoder--.
Col. 14, line 39 after "reset" insert --signal RES-O from a reset--.
Col. 14, line 43 "pulse" should be --pulses--.
Col. 15, line 28 "die" should be --due--.
Col. 15, line 32 "cycle" should be --cyclic--.
Col. 16, line 35 "valve" should be --value--.
Col. 17, line 59 "than" should be --then--.
Col. 17, line 62 "LCT-1" should be --LCL-1--.
Col. 24, line 8 after "signal" delete "SCL-O-of" and insert --SCL-O of the flip-flop 508 to--.
Col. 25, line 64 "30°" should be --300°--.
Col. 26, line 56 "is" should be --in--.
Col. 27, line 39 after "on" insert --and--.

Col. 30, line 37 "is" should be --in--.

UNITED STATES PATENT OFFICE

CERTIFICATE OF CORRECTION

Patent No. 4,048,886 Dated September 20, 1977

Inventor(s) John Francis Zettler

It is certified that error appears in the above-identified patent and that said Letters Patent are hereby corrected as shown below:

Col. 31, line 1 "CLR" should be --CLR-1--.
Col. 31, line 16 "drive" should be --driver--.
Col. 31, line 38 "If it" should be --It is--.
Col. 32, line 6 "signals" should be --signal--.
Col. 32, line 7 "sets" should be --set--.
Col. 32, line 14 "clears" should be --clear--.
Col. 32, line 27 "426" should be --436--.
Col. 33, line 45 "ACR-O" should be --ARC-O--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*